US006629323B2

(12) United States Patent
Sverdlik et al.

(10) Patent No.: US 6,629,323 B2
(45) Date of Patent: Oct. 7, 2003

(54) PATIENT POSITIONING ASSEMBLY

(76) Inventors: David Sverdlik, 6708 W. Hazel St., Morton Grove, IL (US) 60053; Alla F. Sverdlik, 6708 W. Hazel St., Morton Grove, IL (US) 60053

( * ) Notice: Subject to any disclaimer, the term of this patent is extended or adjusted under 35 U.S.C. 154(b) by 49 days.

(21) Appl. No.: 09/751,952

(22) Filed: Dec. 29, 2000

(65) Prior Publication Data

US 2002/0083522 A1 Jul. 4, 2002

(51) Int. Cl.[7] ..... A61G 7/08
(52) U.S. Cl. ..... 5/81.1 C; 5/81.1 R
(58) Field of Search ..... 5/81.1 R, 83.1, 5/85.1, 88.1, 89.1, 81.1 C, 81.1 HS

(56) References Cited

U.S. PATENT DOCUMENTS

| | | | | | |
|---|---|---|---|---|---|
| 395,663 | A | * | 1/1889 | McCord | 24/165 |
| 2,665,432 | A | | 1/1954 | Butler | |
| 2,733,452 | A | | 2/1956 | Tanney | |
| 3,593,351 | A | | 7/1971 | Dove | 5/81 |
| 3,597,774 | A | | 8/1971 | Warren | |
| 4,180,879 | A | | 1/1980 | Mann | |
| 4,446,587 | A | * | 5/1984 | Jump | 254/292 |
| 4,536,903 | A | | 8/1985 | Parker | |
| 4,700,415 | A | | 10/1987 | DiMatteo et al. | |
| 4,747,170 | A | | 5/1988 | Knouse | 5/81 |
| 4,761,841 | A | | 8/1988 | Larsen | 5/81 |
| 4,797,960 | A | | 1/1989 | Vaiana et al. | 5/81 |
| 4,799,273 | A | | 1/1989 | Elze | |
| 4,837,873 | A | | 6/1989 | DiMatteo et al. | |
| 4,868,938 | A | | 9/1989 | Knouse | 5/81 |
| 5,020,171 | A | | 6/1991 | DiMatteo et al. | 5/81 |
| 5,103,512 | A | | 4/1992 | DiMatteo et al. | 5/610 |
| 5,185,894 | A | | 2/1993 | Bastert et al. | 5/81.1 |
| D339,771 | S | | 9/1993 | Newman | D12/128 |
| RE35,468 | E | | 3/1997 | Newman | 5/81.1 |
| 5,608,929 | A | * | 3/1997 | Crane | 5/81.1 R |
| 5,659,905 | A | * | 8/1997 | Palmer et al. | 5/612 |
| 5,697,109 | A | | 12/1997 | Hodgetts | |
| 5,737,781 | A | | 4/1998 | Votel | 5/81.1 |
| D402,434 | S | | 12/1998 | Votel | D34/28 |
| 5,890,238 | A | | 4/1999 | Votel | 5/81.1 |
| 5,901,388 | A | * | 5/1999 | Cowan | 5/81.1 HS |
| 6,012,183 | A | | 1/2000 | Brooke et al. | 5/81.1 |
| 6,282,734 | B1 | | 9/2001 | Holberg | |
| 6,321,398 | B1 | * | 11/2001 | Wang | 5/81.1 R |

* cited by examiner

*Primary Examiner*—Heather Shackelford
*Assistant Examiner*—Lisa Saldano
(74) *Attorney, Agent, or Firm*—Marshall, Gerstein & Borun

(57) ABSTRACT

A patient transfer assembly for moving a sheet on a structure having a transfer surface. The patient transfer assembly includes a gripper adapted for attachment to the sheet, a drive shaft, a cable connected to the gripper and connected to the drive shaft, and a handle connected to the drive shaft for rotating the drive shaft. The handle is adapted to be positioned at a level that is ergonomically comfortable for the user during operation of the assembly. The patient transfer assembly may also include an adjustably positionable idler shaft for guiding the cable between the drive shaft and the transfer surface. Further embodiments of the patient transfer assembly may include an adjustably positionable extension arm for rotation of the drive shaft.

21 Claims, 19 Drawing Sheets

PATIENT POSITIONING ASSEMBLY

BACKGROUND OF THE INVENTION

1. Field of Invention

The invention relates generally to devices for moving a patient on a surface, such as a bed or gurney; for transferring or sliding a patient from one surface to another surface, such as from a bed to a gurney or vice versa, and for rotating a patient from side to side on a bed.

2. Description of Related Technology

Health care workers are responsible for the care of partly or completely incapacitated persons. To adequately care for such persons, the health care professionals are frequently relied upon to move the persons between two different surfaces such as from a bed to a gurney, from a bed to a wheel chair or from a bed to a commode. In certain circumstances, the health care workers only need to move a patient within his or her bed such as sliding the patient toward the head or foot of the bed or rotating the patient from side to side to prevent and/or treat bed sores that may result from extended periods of time lying in one position.

It is not uncommon for a health care worker to be injured during a patient transfer procedure. While transferring a patient, health care worker must often lean over the bed, gurney or wheel chair to pull the patient in the intended direction. As a result, health care workers can injure back, neck and shoulder muscles. The risk of injury is highest when one health care worker is responsible for the care of a patient, however injuries also occur when multiple workers are involved.

While health care workers may be injured during patient transfer, it is also not uncommon for a patient to be injured during the move, or attempted move, from one position to another, or from one structure to another. A patient may be injured when his or her body is grabbed, pulled or pushed during the move. Additionally, a patient may be further injured if the health care worker is unable to successfully move, lift or rotate the patient because the patient may develop bed sores or further irritate already existing sores.

Because of the risk of injury to the health care worker as well as the patient, several mechanisms have been developed to ease the patient transfer process. Although several of these mechanisms have improved the patient transfer process, current designs are still problematic, particularly because they are very complex machines. Many of the new mechanisms utilize a motor that creates a pulling force to assist workers when moving a patient. Generally, these motorized systems include a complex motor housing which pulls a cable or cables attached on one end to the motor unit and on the other end to a special transfer device, such as special boards, straps or web-like structures, onto which the patient has been positioned.

Although these existing systems have provided better methods for transferring patients than previously used methods, these systems often have many disadvantages. First, because of the complexity of the motor units, such mechanisms are costly to manufacture and therefore costly for hospitals, nursing homes and home care specialists to purchase. Second, the automatic nature of the devices may make them complicated to operate and hence may require much training to handle properly. The training of these workers may be time-consuming and costly to the health care providers. Third, existing systems are often very awkward and difficult to use. Fourth, because these systems rely on a motorized, electrical process, these systems may create a dangerous situation for the patient in the event of a power failure, especially in a home health care situation. Fifth, because these mechanisms often require the patient to be transferred with special transfer devices, the risk of injury to the patient is greater. Sixth, existing transfer mechanisms are not desirable because the manually operated models require a health care worker to bend to low levels to rotate a handle which is uncomfortable. Seventh, many of these mechanisms only assist the user for sliding the patient and do not assist the user for lifting or rotating the patient. Finally, many of the existing systems for gripping a bedsheet used in association with the transfer mechanisms are complicated and difficult to use.

There have been several attempts to mechanize the patient transfer process. For example, U.S. Pat. No. 2,665,432 (Butler), (hereinafter "the '432 patent") describes a cart with a manual crank connected to an extensive pull unit. The pull unit has a large number of straps which connect at an edge by hooks to a transfer sheet. Rotation of the crank winds the pull unit onto a roller. The pull unit is difficult to use in that it is attached at many locations to the sheet, and it is wound onto the roller in an awkward manner. In addition, the pull unit must be placed under the person since it would not be kept under the person at all times. Furthermore, the usefulness of the '432 patent is limited in that no way is provided for transferring the patient off the cart.

U.S. Pat. No. 2,733,452 (Tanney) (hereinafter "the '452 patent") describes a transfer system that uses a motorized pulley to transfer a patient using a metal reinforced transfer sheet. The transfer sheet has metal grommets in its corners for the attachment of cables. A motor is used to wind the cable onto reels, thereby moving the sheet. The patient must first be moved onto the transfer sheet to move the patient from a bed to the cart. Furthermore, there is nothing to support the patient on the transfer sheet.

U.S. Pat. No. 4,747,170 (Krouse) (hereinafter "the '170 patent") reveals an alternative motorized winch type transfer system and includes the use of a more general type of transfer sheet. The gripping system for the transfer sheet, though, is difficult and awkward to use.

U.S. Pat. No. 5,737,781 (Votel) and U.S. Pat. No. 5,890,238 (Votel) depict a patient transfer system for horizontal transfer of patients using transfer sheets. The transfer system includes a set of straps attached on one end to the transfer sheets by means of a clamping device and on the other end to reels that are part of a winch. The activation of the winch winds the straps on the reels. The clamping device comprises a rigid cavity formed by two curved sections and has a releasable catch at its opening such that the transfer sheet can be held in the cavity by the catch until the catch is released. The system may also include a rod onto which the sheets are folded, placed in the cavity, and then clamped to hold the sheet-covered rod within the cavity during operation. While this system uses straps and a clamping device to grasp the transfer sheets, this system does not allow the reels to be adjusted to various heights for ease of use by an operator when the system is manually operated.

To overcome the above-mentioned disadvantages, a simple, uncomplicated and convenient mechanism to transfer patients utilizing only the sheets on which these patients rest must be created.

SUMMARY OF THE INVENTION

A patient transfer assembly is provided for moving a sheet across a structure having a transfer surface. The assembly includes a gripper adapted for attachment to the sheet on the transfer surface and a cable coupled to the gripper. The cable is also connected to a drive shaft. The assembly further includes a handle connected to the drive shaft, adapted for rotating the drive shaft and is height adjustable for ergonomically comfortable rotation. The gripper, which is adapted for adjustable positioning on the cable, pulls the sheet as the as the drive shaft is rotated. Some embodiments of the assembly include an idler shaft, coupled to the structure, and adapted to be raised or lowered for keeping the idler shaft adjacent the transfer surface when the cable is entrained over the idler shaft.

Another embodiment of the patient transfer assembly is provided for rotating or lifting a patient above a structure having a transfer surface. The assembly includes a gripper for attachment to a sheet, a trapeze, a pulley attached to the trapeze, and a cable coupled to the gripper and entrained around the pulley so that the gripper pulls the sheet upward as the drive shaft is rotated.

Yet another embodiment of the patient transfer assembly includes an extension arm. The handle may be mounted on the extension arm. The extension arm may be rotatable to adjust the height of the handle for the user of the assembly.

BRIEF DESCRIPTION OF THE DRAWINGS

The invention will be described with reference to the following detailed description of several preferred embodiments and to the drawings, wherein like reference numerals are used to represent like elements, and in which.

DESCRIPTION OF THE PREFERRED EMBODIMENTS

Referring generally to FIGS. 1–44, a patient transfer assembly is designed for moving, including sliding, lifting or rotating, patients on an a transfer surface, or for transferring a patient from one surface to another. The power to move the patient may be generated from the vertical movement of an automatically movable hospital bed in some embodiments of the patient transfer assembly as described below. The power to move the patient may also be created by manual operation of a drive shaft as shown below in some embodiments of the patient transfer assembly. Alternative embodiments of the patient transfer assembly may derive power from any other source commonly known to those skilled in the art. As used herein, the term "structure" may refer to a bed, gurney, wheelchair, commode or a combination of the aforementioned structures, such as a bed with a commode attached. The term "transfer surface" is used to refer to the surface of the structure on which the patient is resting. In accordance with many embodiments of this invention, the transfer surface is generally the top of a mattress; however the transfer surface may also include, but is not limited to, the surface of a gurney or stretcher, a wheelchair and/or a commode. The terms "gripper system" or "gripper" are used to refer to any component or combination of components, according to the invention or as known in the art, that may be used to, first, grasp or hold a sheet and, second, to pull or lift the sheet in a particular direction thereby pulling, lifting or rotating a patient in the desired direction.

Figure 1:
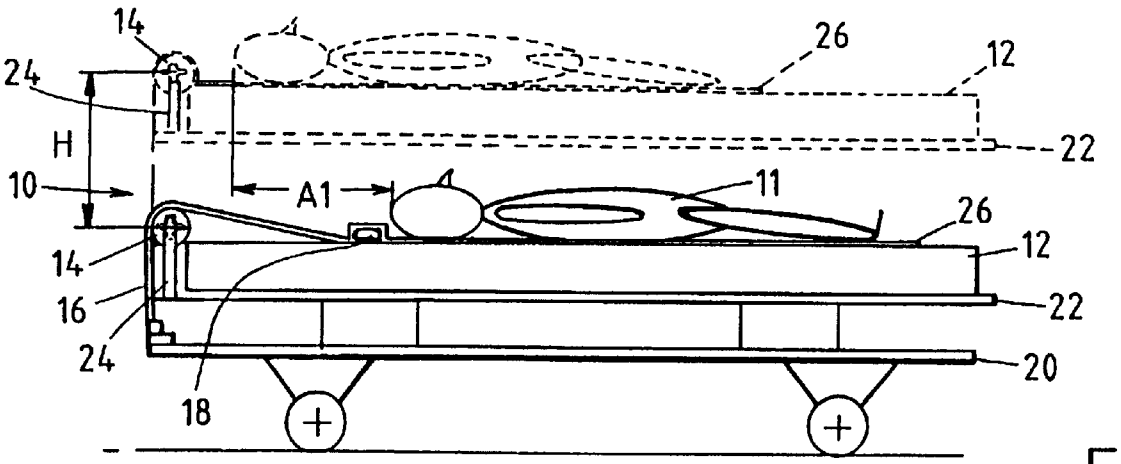
FIG. 1 is a side view of a patient transfer assembly utilizing the power of an automatically movable bed and having guide pulleys located adjacent the transfer surface for sliding the patient.

Referring generally to FIGS. 1–28, and particularly to FIG. 1, a patient transfer assembly 10 for moving a partially or totally incapacitated patient 11 across a transfer surface 12 includes at least one guide pulley 14, at least one pulling cable 16 and at least one gripper 18. The patient transfer assembly 10 is attached to the frame of an automatically movable bed, such as the kind commonly found in hospitals or nursing homes. The automatically movable bed includes a stationary base 20 and a movable platform 22 on which the mattress (transfer surface) and patient are positioned. The automatically movable bed may be easily operated by existing controls on the bed. In this embodiment of the invention, the transfer surface 12 is the top surface of the mattress. The patient is moved by the patient transfer assembly 10 when a sheet 26, on which the patient rests, is pulled in the direction of the assembly 10 such that the patient slides across the transfer surface 12. The pulling force to move or slide the patient is generated by the power of the automatic bed, i.e. the vertical movement of the bed is transformed into a horizontal pulling force which is used to linearly move the gripper system 18 and consequently move the patient as the bed rises from a first position to a second position. The patient transfer assembly, as shown in FIG. 1, has the pulling cable 16 connected on one end to the stationary base 20 and on the other end to the gripper system 18 which is attached to the sheet 26. During operation, the bed is moved from its lowest position relative to the floor to a second, higher position which pulls the pulling cable 16 and, consequently, the patient, in the direction of the patient transfer assembly 10. As illustrated in FIG. 1, the patient is pulled a distance "A1." Accordingly, when the bed moves a distance "H." (the distance between the height of the bed in its lowest position and its highest position), the patient is pulled a distance "A1." The distance "A1" is equal to the distance "H." Hence, the vertical movement of the bed is equal to the horizontal movement of the gripper system. Hereinafter, all embodiments of the patient transfer assembly having a cable with a gripper system attached to one end of a cable and the other end of a cable attached to a stationary base where the cable is guided above a transfer surface by a guide pulley which is mounted on a movable platform will be referred to as "a patient transfer assembly having a single stroke movement construction." This terminology applies to assemblies for lifting, rotating or sliding. In other embodiments, the distance in which the gripper system is pulled or lifted may vary proportionally to the vertical movement of the bed in accordance with different combinations of guide pulleys which guide the movement of the cable during operation of the patient transfer assembly.

As shown in FIG. 1, the pulling cable 16 is connected to the gripper system 18 and to the stationary base 20 of the bed. The guide pulley 14, positioned adjacent the transfer surface 12, is attached to the movable platform 22 by a mounting bracket 24. Alternate embodiments of the patient transfer assembly may have the guide pulley 14 positioned at any desired height either above or below the transfer surface. The guide pulley 14 directs the cable 16 during operation of the assembly 10 for the purpose of, but not limited to, preventing the cable 16 from rubbing against the transfer surface 12 and/or become misaligned. The mounting bracket(s) 24 may be permanently or temporarily fixed to the movable platform 22. It is advantageous to temporarily fix the patient transfer assembly 10 to the bed because the assembly 10 may then be transported to different locations and utilized on different structures to assist health care workers in moving patients.

Figure 2:
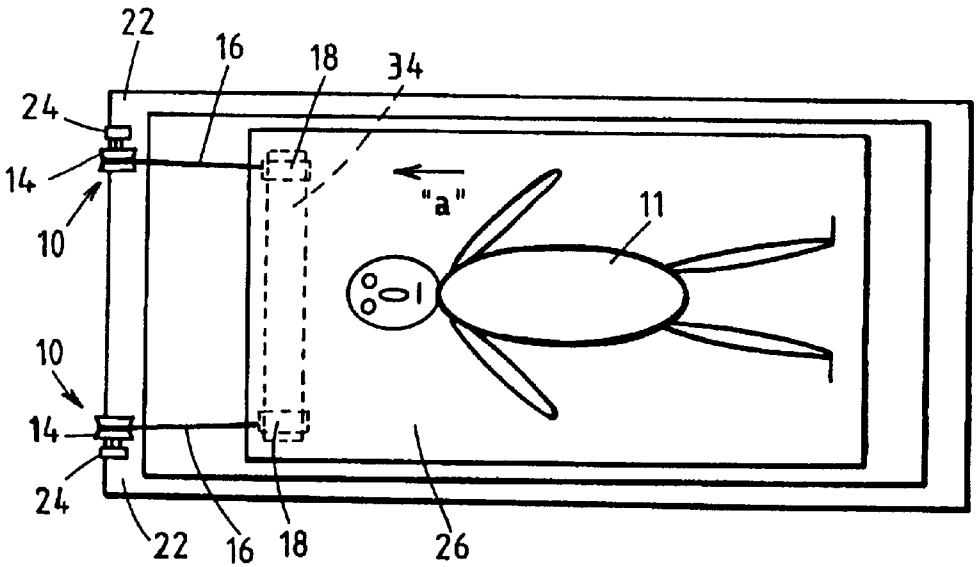
FIG. 2 is a top view of the patient transfer assembly of FIG. 1.

As shown in FIG. 2, the patient transfer assembly 10 may include two guide pulleys 14 and two pulling cables 16. In a preferred embodiment, the guide pulley 14 is made of a plastic because it is light-weight and resistant to wear and may preferably be from 1 to 10 inches in diameter. Additionally, in a preferred embodiment, the pulling cable 16 is nylon because it is readily available, light-weight and durable. In alternate forms of the invention, the guide pulley and the pulling cable may be comprised of any materials having characteristics similar to those described above and known by those skilled in the art. Although FIG. 1 and FIG. 2 depict the patient transfer assembly 10 at the end of the bed for moving the patient toward the head or foot of the bed, the patient transfer assembly 10 may be positioned on either side of the bed for moving the patient from side to side. The patient is moved in the direction of the arrow labeled "a." "Head" and "foot" are meant to refer to one or the other end of a bed as is commonly known. In alternate forms of the patient transfer assembly, the guide pulleys may be attached to a rod to keep the pulleys properly aligned and to provide additional structural support to the patient transfer assembly. The rod may be mounted between mounting brackets attached to the frame of the structure on which the patient rests.

There are several advantages associated with using the power of the automatic bed as the pulling force for the patient transfer assembly 10. First, the bed provides the source of power so no other source of power is needed. In addition, the motors used with these beds are typically set at a slow, steady, predetermined speed. This controlled speed provides a constant, gentle force for pulling patients which may prevent accidental injury to the patient caused by jerky, forceful movements. Additionally, because a health care worker cannot adjust the speed, there is little need for special training to teach such a worker how to properly operate the mechanical assembly. Further, the patient transfer assembly, in accordance with embodiments described herein, is an improvement over current patient transfer mechanisms because current mechanisms often require the use of a special motor to transfer the patients which may be difficult to operate. Also, the complexity of current mechanisms may make them expensive to manufacture. Accordingly, the simplicity of the patient transfer assembly of this invention as shown in FIG. 1 and those described hereinafter are easier to operate, cheaper to manufacture and, thus, more desirable.

Figure 3:
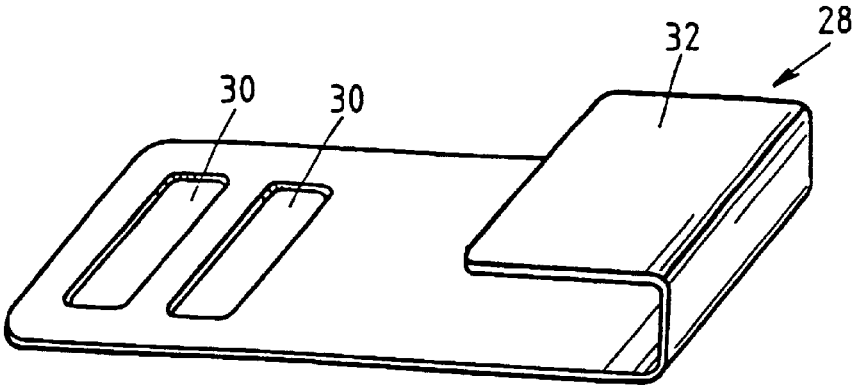
FIG. 3 is a perspective view of a C-shaped gripper component of the gripper system of FIG. 1.
Figure 4:
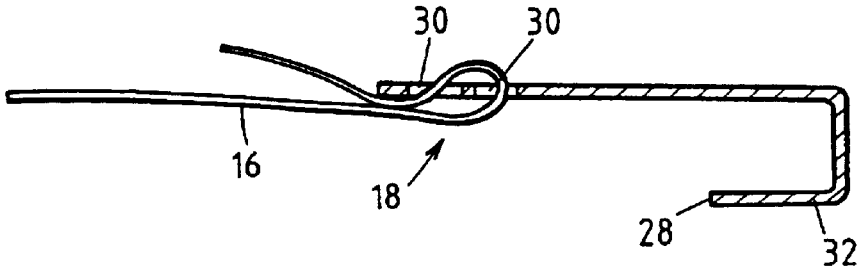
FIG. 4 is a side view of a gripper system including the C-shaped gripper component of FIG. 3 connected to a cable.

Referring now to FIGS. 3–15, the gripper system 18 has several different preferred embodiments. As shown in FIG. 3, the gripper system 18 may include a C-shaped gripper component 28 which has two slots 30 for securing the pulling cable 16 to the C-shaped gripper component 28 as is shown in FIG. 4. Alternative embodiments of the C-shaped gripper component 28 could have any number of slots 30 to secure the cable 16 to the gripper system 18. The C-shaped gripper component 28 includes a curved flange 32 that forms a hook-like structure for grasping a cross-bar 33 wrapped with the sheet, as described in greater detail below. In one preferred embodiment, the gripper component 28 is made of a light-weight, durable metal such as aluminum. In alternate forms of the invention, the C-shaped gripper 28 may be comprised of any material known to those skilled in the art to be light-weight and durable. Additionally, because the C-shaped gripper component 28 is composed of a light material, the gripper is easy to use, store and transport. Further, the gripper component 28 ergonomically designed so that is comfortable and easy to use.

Figure 5:
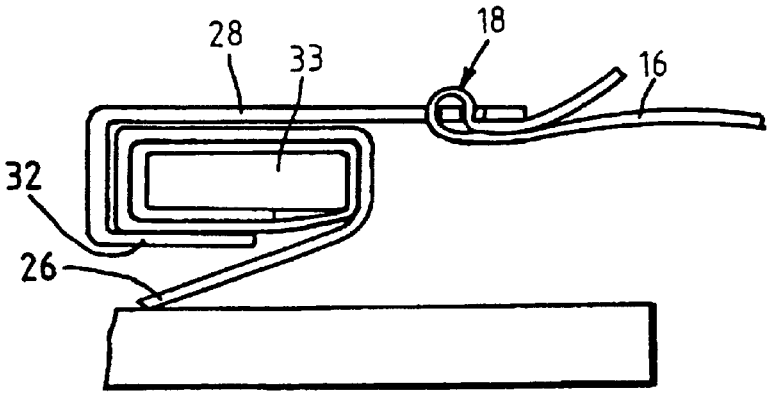
FIG. 5 is a side view of the gripper system of FIG. 4 engaging a cross-bar component for pulling a sheet.

As depicted in FIG. 5, the gripper system 18 may also include a cross-bar 33 to be used with the C-shaped gripper component 28. The cross-bar 33 is not connected to the gripper 18 and, as a result, the gripper 18 may be positioned at any point along the length of the cross-bar 33. As used in this embodiment of the patient transfer assembly 10, the cross-bar 33 has a rectangular shape with rounded corners on each end and is made from a light, rigid material, such as aluminum or any other material which is strong enough to withhold a pulling force during the transfer of a patient. As shown in FIG. 5, in preparation for patient transfer, the sheet 26 is wrapped around the cross-bar 33. Then after the sheet 26 is properly in place, the sheet 26 and cross-bar 33 engage the curved flange 32 of the C-shaped gripper component 28. The C-shaped gripper component 28 acts as a hook to securely hold the cross-bar 33. When the cable 16 is pulled during operation of the assembly, the cross-bar 33 is forced into the C-shaped gripper component 28. When the sheet 26 is positioned between the C-shaped gripper component 28 and the cross-bar 33, the sheet 26 is pinched there between so that pulling forces exerted on the C-shaped gripper component 28 are transferred to the cross-bar 33. Thus, the cross-bar 33 is the component of the assembly which equally distributes the pulling forces to the sheet 26. All pulling forces created by the pulling cables are transmitted to the sheet 26 through the cross-bar 33, thereby, making the size of the cross-bar the determining factor for preventing tearing of the sheet 26. In a preferred embodiment, the cross-bar preferably has a length in the range of 28–36 inches, but may be shorter or longer in other embodiments. When a cross-bar having a length in this preferred range is used, the sheet is less likely to tear during operation of the assembly. Additionally, alternate embodiments of the patient transfer assembly may utilize a single cross-bar of any length or multiple cross-bars of any length.

Figure 6:
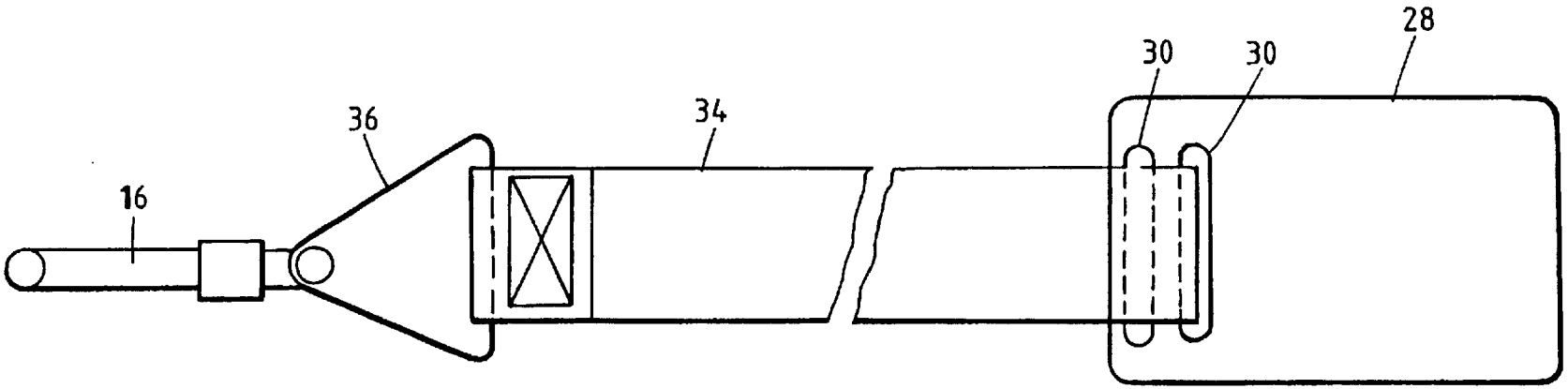
FIG. 6 is a top view of a strap and link for connecting the C-shaped gripper component of the gripping system to the rounded cable.
Figure 7:
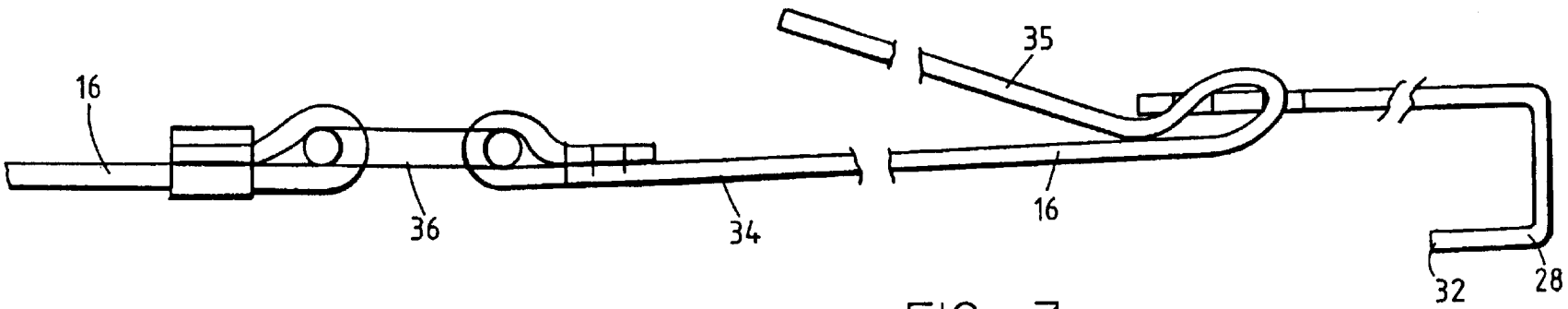
FIG. 7 is a side view of the strap and link for connecting the C-shaped gripper component of the gripping system to the rounded cable of FIG. 6.

Because the cross-bar 33 and the sheet 26 may not be properly aligned, the position of the C-shaped gripper component 28 on the pulling cable 16 is adjustable. As shown in FIGS. 6 and 7, the gripper system 18 may include a strap 34 which connects the C-shaped gripper component 28 to the cable 16. The position of the C-shaped gripper 28 on the pulling cable may be adjusted by adjusting the length of the strap 34 by pulling or loosening the end 35 which will create an initial tension on the belt between the belt and the gripper 28. This readjustment of the strap 34 helps correct imperfect alignment of the cross-bar 33 and sheet 26 and ensures that the sheet 26 is pulled parallel to the drive shaft during operation to minimize tearing or twisting of the sheet 26. The grippers 28 may be repositioned on cable 16 by adjusting the length of the strap 34 before or after the gripper 28 is engaged with the sheet 26 and cross-bar 33. As is shown in FIG. 6, one end of the strap 34 may be looped through the slots 30 of the C-shaped gripper component 28 and the other end of the strap 34 may be connected to the cable 16 by a link 36. In a preferred embodiment, the link 36 is a durable, light-weight, metallic, triangular clip. The strap 34 is preferably made of nylon because it is light-weight and durable. In alternate forms of this invention, the strap 34 may be made of any other material possessing similar properties as known to those skilled in the art.

Figure 8:
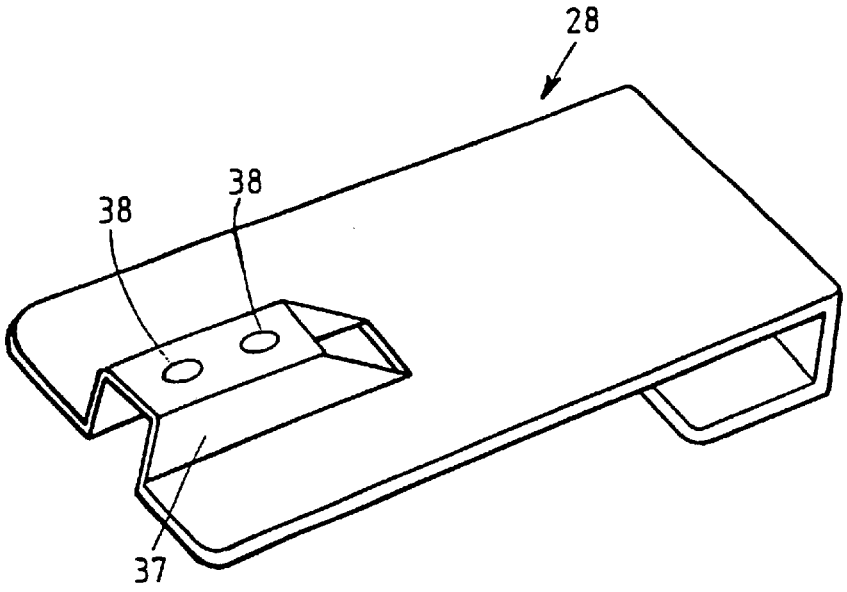
FIG. 8 is a perspective view of another embodiment of the C-shaped gripper component.
Figure 9:
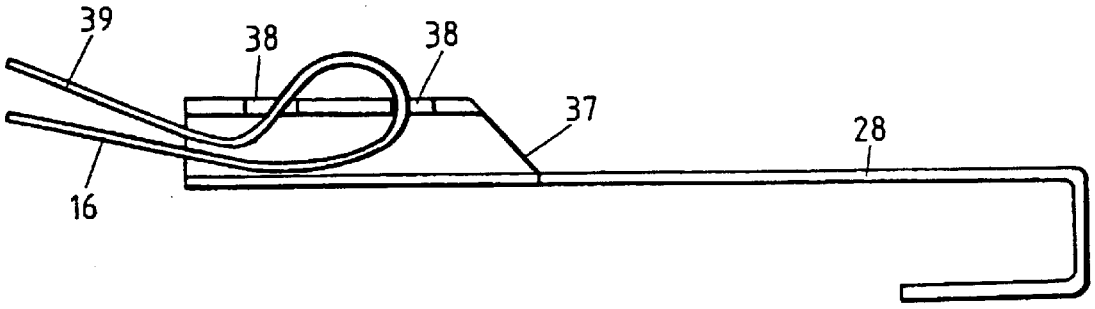
FIG. 9 is a side view of the C-shaped gripper component of FIG. 8 connected to the cable.
Figure 10:
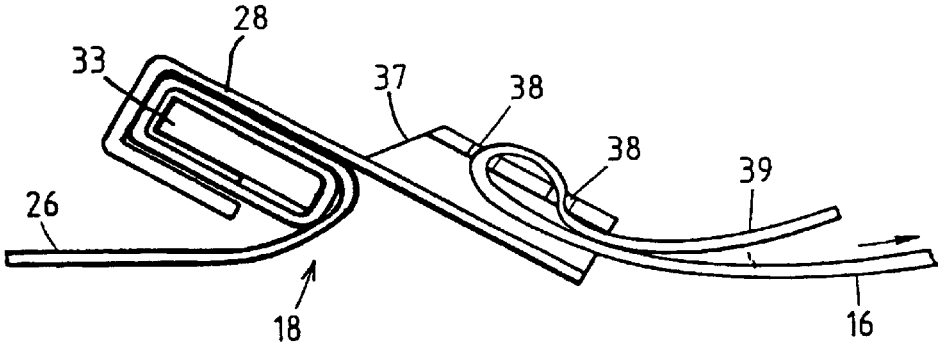
FIG. 10 side view of the gripper system of FIG. 4 engaging a cross-bar component for pulling a sheet.

As shown in FIGS. 8–10, the gripper system 18 may have a different embodiment. As depicted in FIG. 8, the gripper system 18 may include a C-shaped gripper component 28 that includes a chute-like bracket 37 fixed to the C-shaped component 28. The body 37 has two holes 38 through which the cable 16 may pass to secure the cable 16 to the C-shaped gripper component 28 as is shown in FIG. 9. Because the cable 16 is secured tightly within the bracket 37, this embodiment of the C-shaped gripper component 28 may prevent the cable 16 from coming loose during operation of the patient transfer assembly. Alternative embodiments of the C-shaped gripper component 28 could have any number of holes 38 to secure a cable to the gripper system 18. This embodiment of the gripper component 28 maybe made of a light-weight, durable metal such as aluminum. In alternate forms of the invention, the C-shaped gripper 28 may be comprised of any material known to those skilled in the art to be light-weight and durable. As depicted in FIG. 10, the gripper component 28 having the bracket 37 may also be used with the cross-bar 33. To correct for misalignment of the cross-bar 33 and the sheet 26 and to ensure that the sheet is moved parallel to the drive shaft of the patient transfer assemble, the end 39 of the cable 16 may pulled to reposition the C-shaped gripper component 28.

Figure 11:
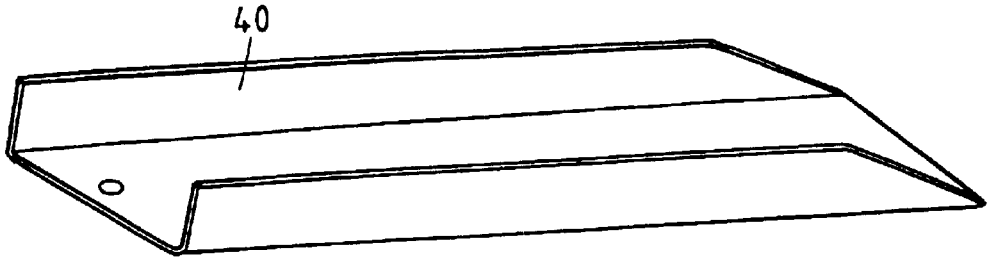
FIG. 11 is a perspective view of a sleeve component of a gripper system.
Figure 12:
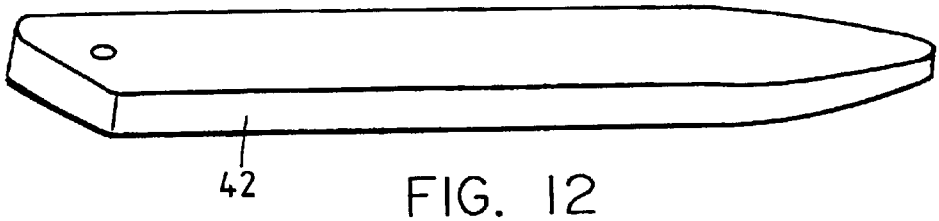
FIG. 12 is a perspective view of a tapered cross-bar component of a gripper system.
Figure 13:
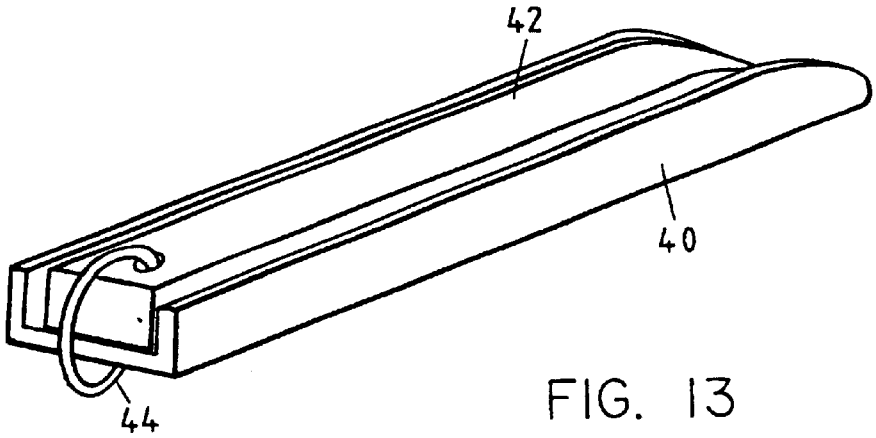
FIG. 13 is a perspective view of the cross-bar of FIG. 12 engaging the sleeve of FIG. 11.
Figure 14:
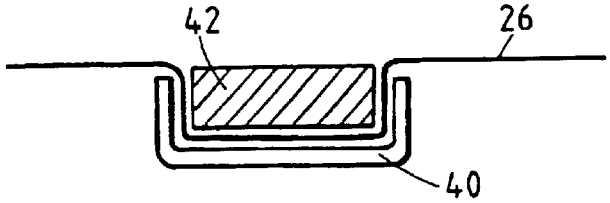
FIG. 14 is a side view of the sheet gripped by the cross-bar of FIG. 12 and sleeve of FIG. 11.

FIGS. 11–15 show additional components of the gripper system 18 that may be used in connection with the C-shaped gripper component 28. A sleeve 40 of FIG. 11 is designed to receive a tapered bar 42 of FIG. 12. The sleeve 40 and tapered bar 42 may be engaged as is shown in FIG. 13. The sleeve 40 and bar 42 are both tapered at one end to ease the insertion of each gripper system component under the sheet or pillow on which the patient rests. As shown in FIG. 13, a connecting element 44 may be passed through the sleeve 40 and tapered bar 42 at the non-tapered end of both the sleeve 40 and the tapered bar 42 to hold the tapered bar 42 securely within the sleeve 40 during operation of the patient transfer assembly 10. As shown, the connecting element 44 is a ring, however the connecting element may take another form in alternate embodiments. FIG. 14 shows the sheet 26 sandwiched between the sleeve 40 and the tapered bar 42.

Figure 15:
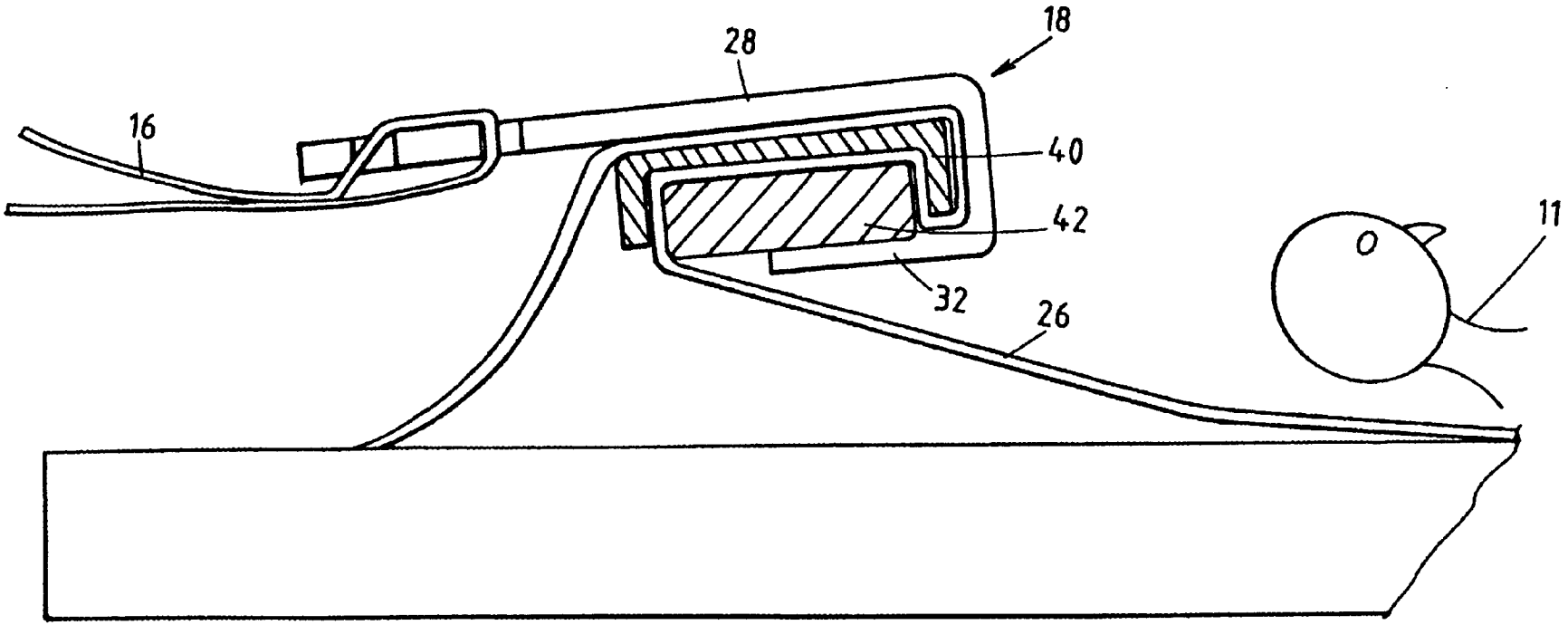
FIG. 15 is a side view of the gripper system, including the cross-bar component, the sleeve component and the C-shaped gripper component for grasping and pulling the sheet.

Because the tapered bar 42 fits securely within the sleeve 40, the sheet 26 is held tightly during operation of the patient transfer assembly 10. In FIG. 15, the sleeve 40 and tapered bar 42 are gripped by the C-shaped gripper component 28 of the gripper system 18. When the cable 16 is pulled during operation of the assembly 10, the sleeve 40 which houses the tapered bar 42 and sheet 26 will engage the flange 32 of the C-shaped component 28 and become jammed thereby preventing the sleeve 40 from escaping from the C-shaped gripper component 28. The gripper system 18 including the sleeve 40, tapered bar 42, connecting element 44 and C-shaped gripper component 28 may be used in different embodiments of the patient transfer assembly described in accordance with this invention.

Figure 16:
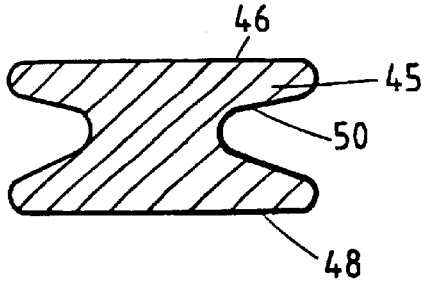
FIG. 16 is a side view of a disc-shaped gripper component of an alternative embodiment of the gripper system.
Figure 17:
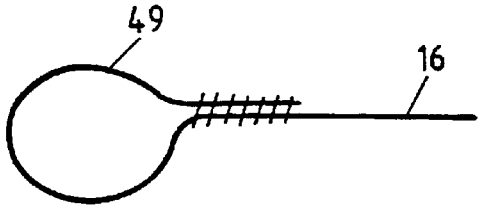
FIG. 17 is a top view of one end of a cable of the patient transfer assembly formed into a ring for engaging the disc-shaped gripper component of FIG. 16.
Figure 18:
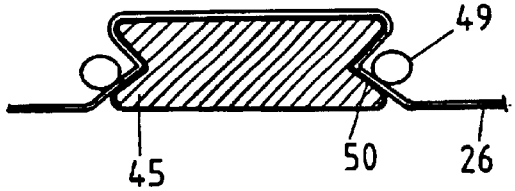
FIG. 18 is a cross-section view of the cable engaging the disc-shaped gripper component of FIG. 16 for gripping a sheet.
Figure 19:
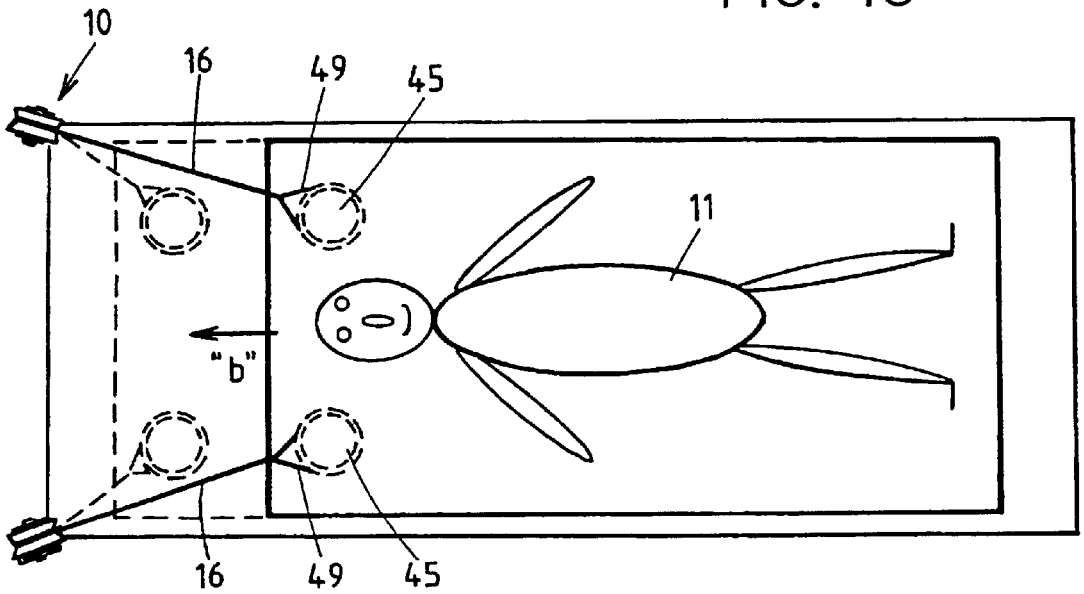
FIG. 19 is a top view of a patient transfer assembly utilizing the gripper system of FIG. 18.

Referring to FIGS. 16–19, the patient transfer assembly 10 may be used with a yet another embodiment of the gripper system 18. As is shown in FIG. 16, a disc-shaped gripper component 45 may be used. The disc-shaped gripper component 45 is circular in structure, has a flat surface on its top 46 and bottom 48, and has a groove 50. As shown in FIG. 17, the pulling cable 16 maybe formed into a loop or have a ring or other loop-like component 49 that engages the disc-shaped gripper component 45. As shown in FIG. 18, the cable 16 grasps or grips the sheet 26 when the cable 16 or loop-like component 49 is inserted into the groove 50. In FIG. 18 the loop-like component 49 is shown firmly gripping the sheet 26. As is shown in FIG. 19, when using the disc-shaped gripper component 45 as a part of the gripper system of the patient transfer assembly, it may be necessary to use at least two disc-shaped gripper components 45 and two pulling cables 16. In this embodiment, to adequately distribute the weight of the patient and to prevent tearing the sheet 26, the gripper components 45 are preferably placed near the corners of the sheet 26 with each placed at an equal distance from the patient. As is also shown in FIG. 19, during operation of the assembly, the gripper components 45 and the patient are pulled in the direction of the patient transfer assembly 10 labeled as direction arrow "b." The disc-shaped gripper component 45 is preferably made of aluminum because it is light-weight, durable and resistant to deformation. In alternate embodiments of the invention, the disc-shaped gripper component 45 may be made of any other metal or material possessing similar properties.

Figure 20:
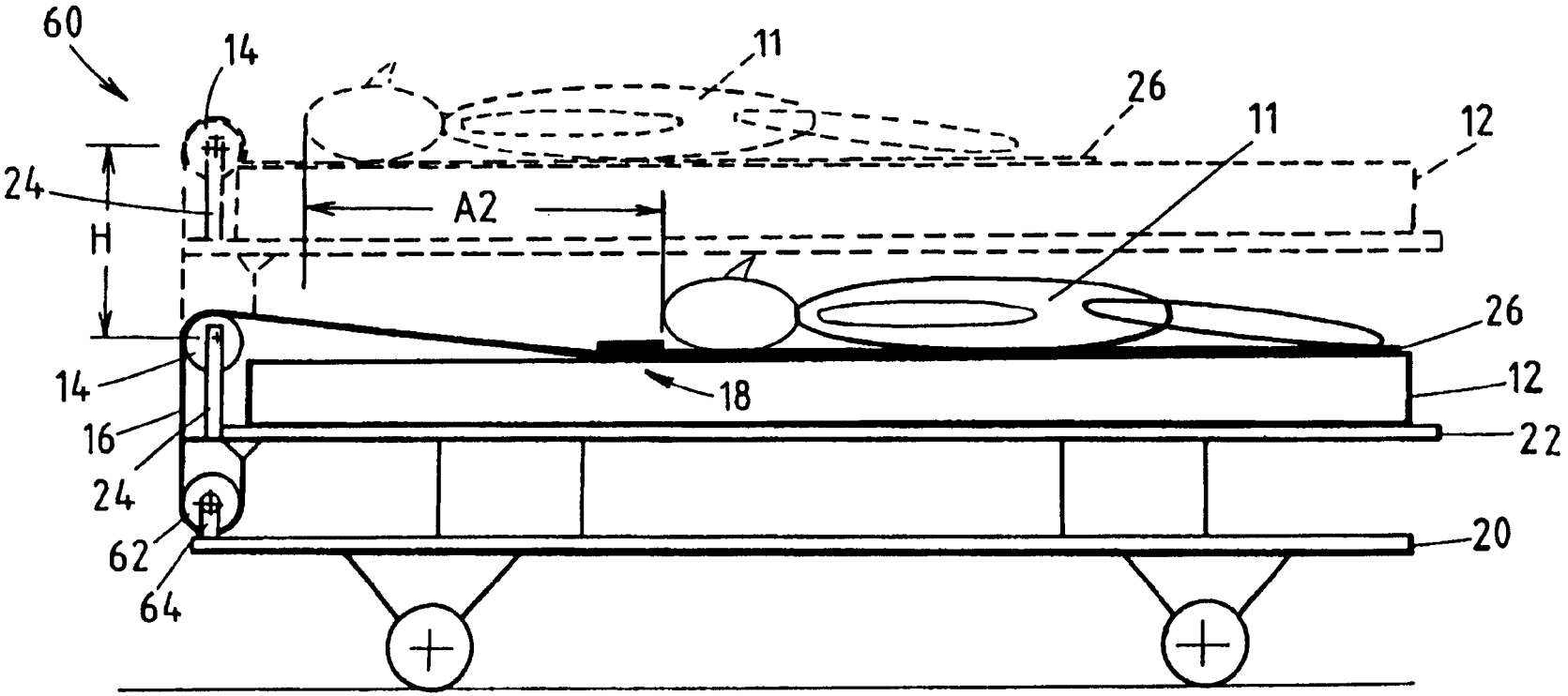
FIG. 20 is a side view of a patient transfer assembly utilizing the power of an automatically movable bed and having a multiple stroke movement construction.

In alternate embodiments of the patient transfer assembly, which transform the power of an automatically movable bed into a pulling or lifting force, the assembly may be designed with additional guide pulleys fixed to the stationary base to increase the distance the patient is moved (i.e., pulled, slid, rotated or lifted). The different combination of pulleys attached to the stationary and movable portions of an automatically movable bed proportionally multiply the movement of the grippers relative to the vertical movement of the bed. Referring now to FIG. 20, the patient transfer assembly 60 includes a second guide pulley 62 attached to the stationary base 20 of the automatically movable bed by a mounting bracket 64 which proportionally doubles the movement of the gripper relative to the vertical movement of the bed. As is shown in FIG. 20, the first guide pulley 14 is positioned adjacent the transfer surface. Like the patient transfer assembly 10 of FIG. 1, the pulling force to move the patient 11 using this embodiment of the patient transfer assembly 60 is generated by transforming the power of the automatic bed. The patient transfer assembly 60 pulls or slides a patient when the bed is raised from a low position to a high position. When the bed is in the low position (the bed is in its lowest position in the solid line depiction of FIG. 20), a health care worker can attach any component or combination of components of the aforementioned gripper system 18 to the sheet 26. As the bed raises from its first, low position to its second, high position, the patient is pulled in the direction of the patient transfer assembly 60. As illustrated in FIG. 20, the patient is pulled a distance "A2" when the bed moves a distance "H" (the distance between the height of the bed in the lowest position and the highest position). The distance "A2" may be twice the distance "H." Comparing the different embodiments associated with FIGS. 1 and 17, it is advantageous to have the pulling cable 16 entrained over a second guide pulley 62 attached to the stationary base 20 because this combination of pulleys increases the distance the gripper system moves during operation of the assembly even though the vertical distance traveled by the bed is a constant. Hereinafter, all embodiments of the patient transfer assembly which include at least one guide pulley attached to a moveable platform and at least one guide pulley attached to a stationary base will be called "a patient transfer assembly having a multiple stroke movement construction." This terminology applies to assemblies for lifting, rotating or sliding.

Figure 21:
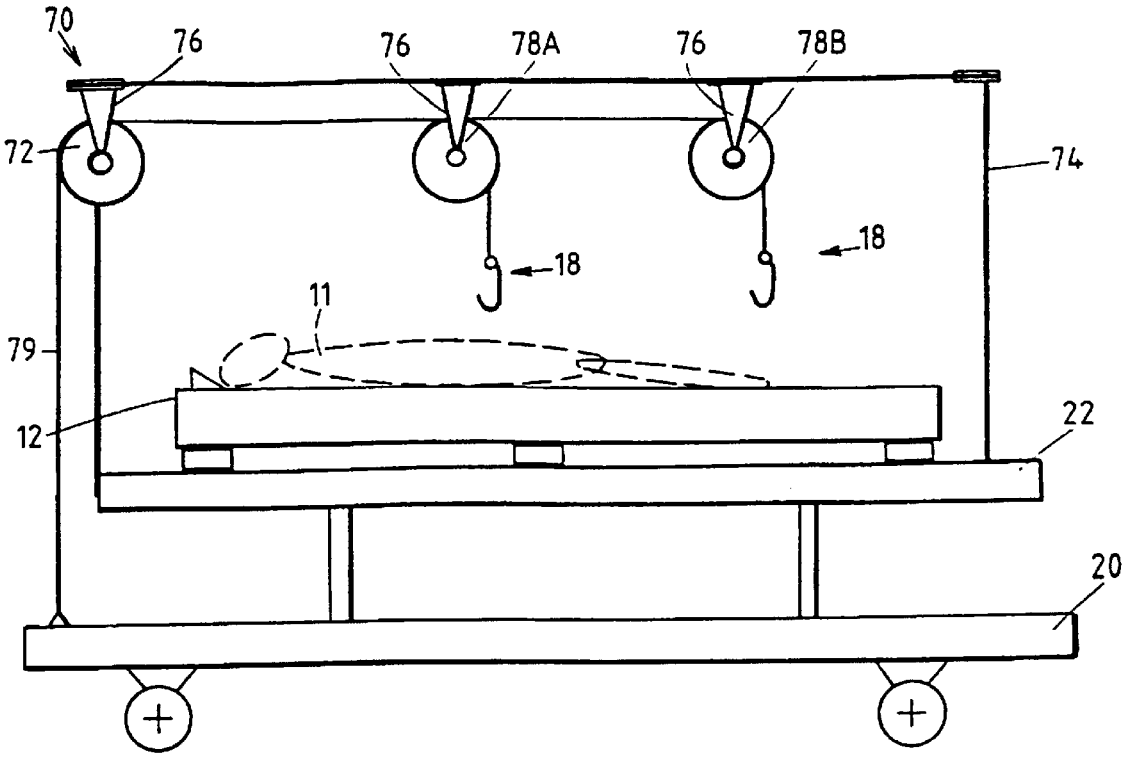
FIG. 21 is a side view of a patient transfer assembly utilizing the power of an automatically movable bed and having guide pulleys located above the patient.

Another embodiment of the patient transfer assembly can be used to rotate or lift a patient rather than pull the patient across the transfer surface. In particular, attaching the guide pulley to a structural frame rising above the transfer surface, the gripper system may be used to rotate or lift the patient. As is shown in FIG. 21, the patient transfer assembly 70 may have the first guide pulley 72 located above the transfer surface 12. The guide pulley 72 is attached to a trapeze 74 by means of a mounting bracket 76. The term "trapeze" is meant to refer to the frame-like structure rising above the moveable platform, spanning the length of the bed and supporting the pulleys, cable(s) and gripper system of the assembly. The patient transfer assembly 70 also includes a first hanging pulley 78A and a second hanging pulley 78B, both of which are attached to the trapeze 74 by a mounting bracket 76. A health care worker using this embodiment of the patient transfer assembly can rotate or lift a patient above the transfer surface 12. For this reason, the cable used in connection with patient transfer assembly 70 is referred to as a rotating cable 79. Like the patient transfer assembly 10 of FIG. 1, patient transfer assembly 70 generates its pulling force from the power of the automatically moveable bed by transforming the vertical movement of the bed into a force that can be used to vertically move the patient. Once the gripper system 18 of this embodiment of the patient transfer assembly has been secured to the sheet 26 and the bed is moved from a first low position to a high low position, the rotating cable 79, coupled to gripper system 18 lifts and rotates the patient.

Figure 22:
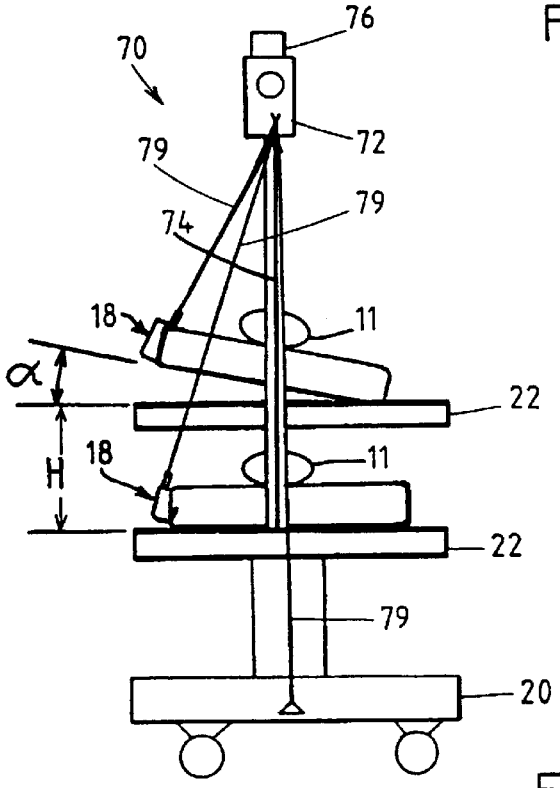
FIG. 22 is a front view of the patient transfer assembly of FIG. 21 showing the rotation of the patient when the bed is moved from a first position to a second position.

FIG. 22 shows the patient being lifted or rotated at an angle "$\alpha$" from the transfer surface 12 when the automatic bed is raised a distance "H," from the bed's lowest position to its highest position. If the bed is raised a distance less than the maximum possible distance "H" the patient may be lifted or rotated to an angle less than "$\alpha$."

Other embodiments of the patient transfer assembly have a driving cable and driving pulley combination. This combination moves the patient by first rotating the driving shaft which in turn pulls the pulling cables and attached gripper system. If the patient transfer assembly includes the driving cable and driving pulley combination, the maximum linear movement of the gripper system varies depending on the vertical movement of the bed as well as the size of the driving and pulling pulleys utilized on the assembly. The drive shaft is a structural element for winding and unwinding the pulling and/or rotating cables thereby transmitting the pulling force to the gripper system of the assembly. Patient transfer assemblies including the drive cable and driving pulley combination may be attached to any part of the structure on which the patient rests.

Figure 23:
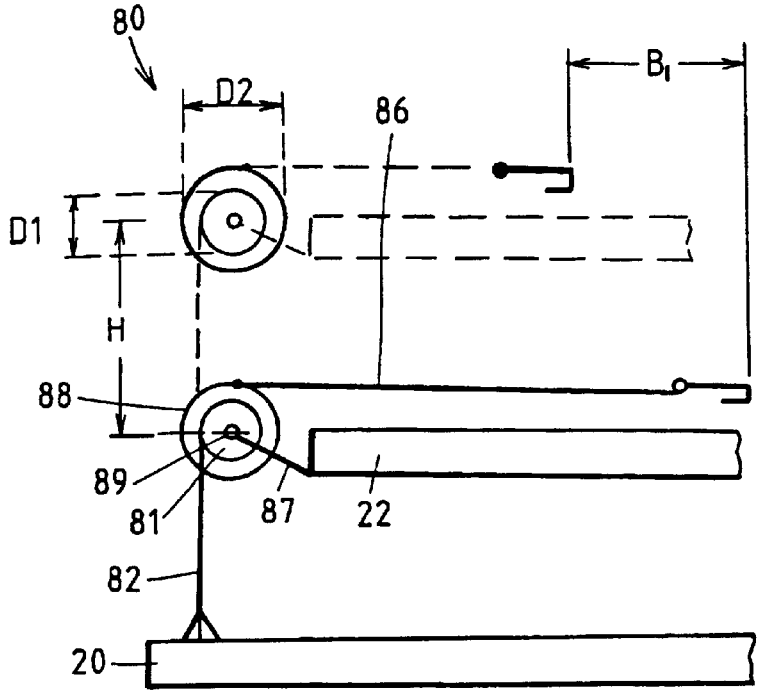
FIG. 23 is a side view of a patient transfer assembly utilizing the power of an automatically movable bed, having single stroke movement construction, and having a drive shaft, a drive cable and a pulling cable.

Patient transfer assembly 80, shown in FIG. 23, includes a driving cable 82 and driving pulley 81 combination. Like the assembly of FIG. 1, the patient transfer assembly 80 generates the pulling force needed to move a patient from the power of an automatically movable bed. The drive cable 82 is fixed on one end to the stationary base 20 of the bed and on the other end to the drive pulley 81, having a diameter "D1." The drive pulley 81 is attached to a drive shaft 84 (FIG. 21). As the bed moves from a lower position to a higher position, as shown in FIG. 20, the drive cable 82 unwinds from the drive pulley 81 causing the drive shaft 84 to rotate. Hence, the vertical movement of the bed is transformed into a force sufficient to rotate the drive shaft 84. The patient transfer assembly 80 also includes a pulling cable 86 that is fixed on one end to a pulling pulley 88 (FIG. 21), having a diameter "D2," and is connected on the opposite end to any of the above-described gripper systems. The pulling pulley 88, attached to the drive shaft 84, guides the pulling cable 86 during operation of the assembly. The drive shaft 84 may be fixedly attached or removably attached to the bed by a mounting bracket 89 having a support rod 87 or by vertical support bars (not shown). If removably attached to the bed, the drive shaft can be adjustably positioned so that the pulling pulley 88 is positioned adjacent to the transfer surface to properly guide the pulling cable 86 during operation of the assembly. The rotation of the drive shaft 84 causes the pulling cable 86 to wind around the pulling pulley 88 and, consequently, pull the patient across the transfer surface 12. As the bed raises from its first, low position to its second, high position, the patient is pulled in the direction of the patient transfer assembly 80. As illustrated in FIG. 23, the patient is pulled a distance "B1." Thus, when the bed moves a distance "H" (the distance between the height of the bed in the lowest position and the highest position in this embodiment), the patient is pulled a distance "B1." In this embodiment of the patient transfer assembly, the distance traveled by the grippers across the transfer surface is affected by the diameters of the driving pulley 81 (D1) and the pulling pulley 88 (D2). For example, the distance traveled by the grippers will decrease as the diameter (D1) of the driving pulley increases.

Figure 24:
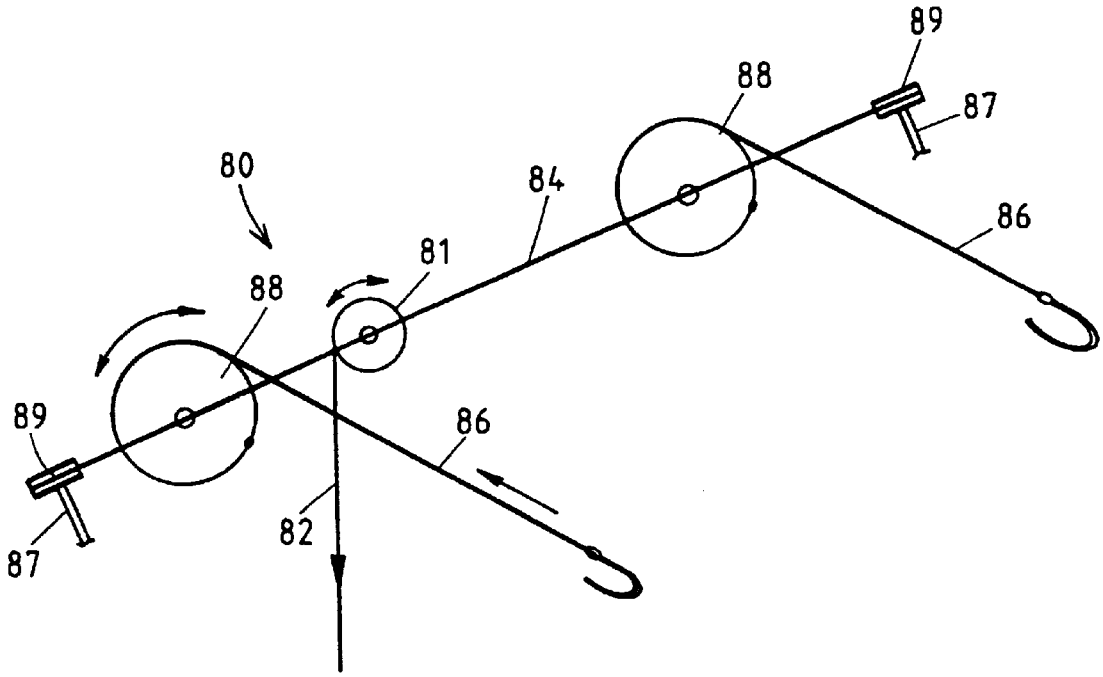
FIG. 24 is a perspective view of the drive shaft of FIG. 23.

FIG. 24 shows the drive shaft 84 of patient transfer assembly 80. The drive pulley 81 is depicted with the drive cable 82 extending down from the drive shaft 84. The drive shaft 84 is shown having two guide pulleys 88; however, any number of drive pulleys 88 could be used with the patient transfer assembly 80.

Figure 25:
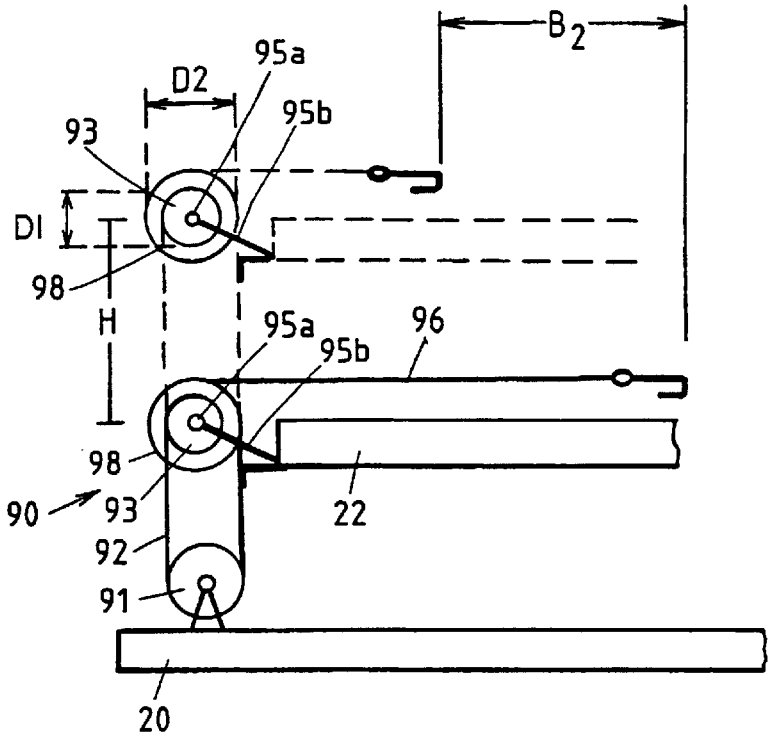
FIG. 25 is a side view of a patient transfer assembly utilizing the power of an automatically movable bed, having multiple stroke movement construction, and having a drive shaft, a drive cable and a pulling cable.
Figure 26:
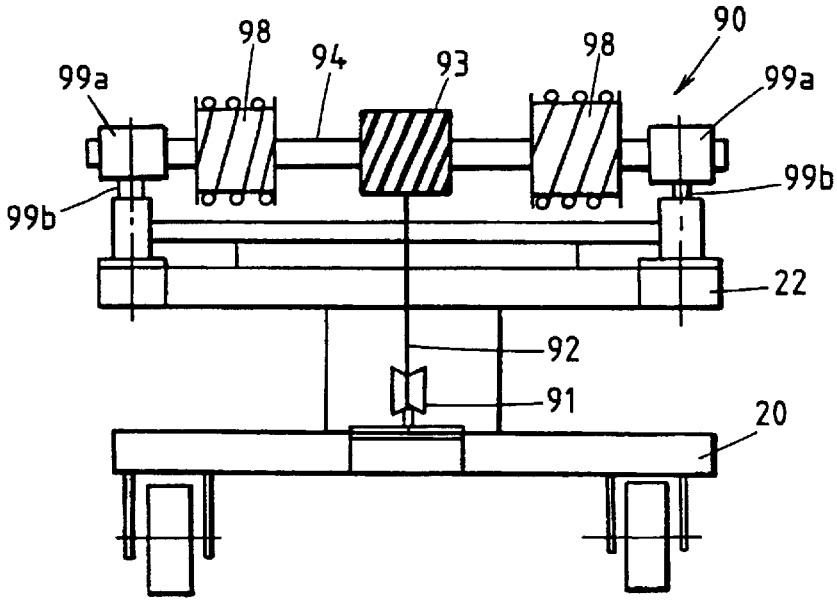
FIG. 26 is a front view of the drive shaft of FIG. 25.

As illustrated in FIG. 25, the patient transfer assembly 90 may include a driving cable and driving pulley combination to transform the energy of an automatic bed into a horizontal pulling force. As is shown, this assembly 90 includes a guide pulley 91 attached to the stationary base 20. Like the aforementioned assemblies, patient transfer assembly 90 generates the pulling force needed to move a patient from the power of an automatically movable bed. A drive cable 92 is fixed to the movable platform 22 of the bed on one end, entrained around the guide pulley 91, and fixed to a first movable drive pulley 93, having a diameter "D1," on the other end. The drive pulley 93 is attached to a drive shaft 94 (FIG. 26). When the bed moves from a lower position to a higher position, as shown in FIG. 25, the drive cable 92 unwinds from the drive shaft 94 causing the drive shaft 94 to rotate. The patient transfer assembly 90 also includes a pulling cable 96 that is fixed on one end to a pulling pulley 98, having a diameter "D2," and is connected on the opposite end to any of the above-described grippers. The pulling pulley 98, attached to the drive shaft 94, guides the pulling cable 96 during operation of the assembly. The drive shaft 94 may be fixedly or removably attached to the bed by a mounting bracket 95*a* having a support rod 95*b*. If removably attached to the bed, the drive shaft 94 can be adjustably positioned so that the pulling pulley 98 is positioned adjacent to the transfer surface to properly guide the pulling cable 96 during operation of the assembly 90.

The embodiment of the assembly shown in FIGS. 25 and 26 has a multiple stroke movement construction. Thus, when the drive shaft 94 rotates, the pulling cable 96 winds around the guide pulley 91 and over the pulling pulley 98 to pull the patient across the transfer surface 12 in the direction of the patient transfer assembly 90. As illustrated in FIG. 25, the patient is pulled a distance "B2." Thus, when the bed moves a distance "H" (the distance between the height of the bed in the lowest position and the highest position in this embodiment), the patient is pulled a distance "B2." In this embodiment of the patient transfer assembly, the movement of the grippers across the transfer surface is affected by the diameters of the driving pulley 91 (D1) and the pulling pulley 98 (D2).

FIG. 26 shows a variation of the patient transfer assembly 90. In this embodiment, the drive shaft 94 is connected to the movable platform by mounting brackets 99*a* which may be fixedly or removably attached to vertical support bars 99*b*. In alternative embodiments of the assembly, the drive shaft may be mounted on the movable platform by any means known to those skilled in the art. Patient transfer assembly 90 is depicted with one idler pulley 91, one drive cable 92 and one drive pulley 93 are depicted in this embodiment. However, any number of each component of assembly 90 could be used in alternative forms of the invention. Similarly, although the assembly 90 is shown having two guide pulleys 98, any number of guide pulleys could be used in alternative embodiments of the invention.

Figure 27:
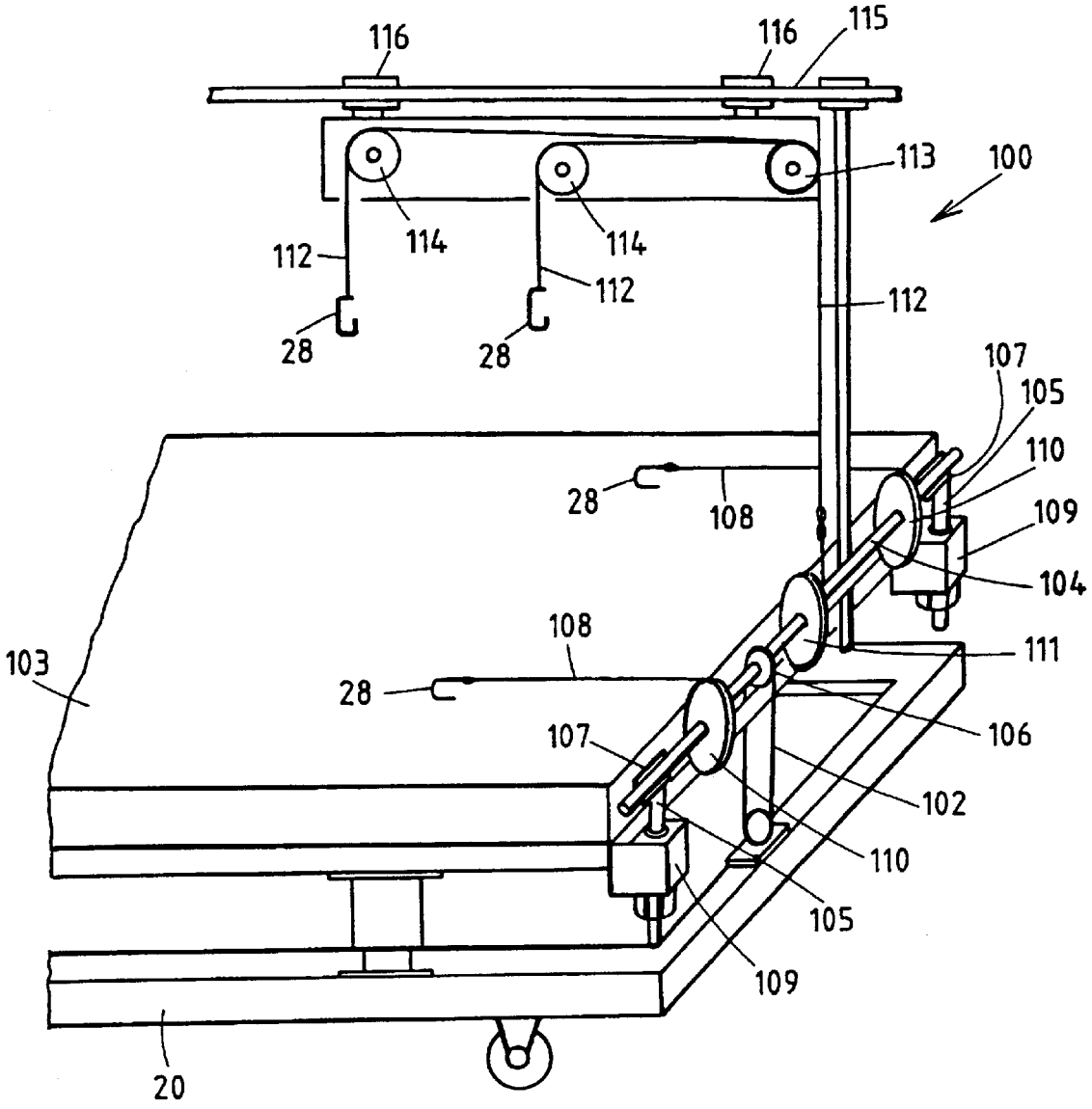
FIG. 27 is a perspective view of a patient transfer assembly utilizing the power of an automatically movable bed to pull and rotate a patient and having a drive cable, two pulling cables and a rotating cable.

A variation of the patient transfer assembly may combine structural aspects of the patient transfer assemblies described previously or hereinafter. For example, patient transfer assembly 100 of FIG. 27 utilizes the rotation mechanism described in association with patient transfer assembly 70 of FIG. 21 and the pulling mechanism described in association with patient transfer assembly 90 of FIG. 25. Accordingly, this assembly 100 performs both the pulling and rotating functions discussed in association with assemblies 70 and 90. Patient transfer assembly 100 includes at least one drive cable 102 and a drive shaft 104 which converts the power of the automatically movable bed into energy that can be used to move an incapacitated patient. The drive shaft 104 is located adjacent to the transfer surface 103. The drive cable 102 is fixed to the stationary base 20 of the bed and fixed to a first drive pulley 106 attached to a drive shaft 104. As the bed moves from a first position to a second position, the drive cable 102 unwinds from the drive shaft 104 causing the drive shaft 104 to rotate. Patient transfer assembly 100 also includes at least one pulling cable 108 that is fixed to a pulling pulley 110 on the drive shaft 104 and is also connected to any of the above-described gripper systems. (The C-shaped gripper component 28 is shown.) The drive shaft 104 is mounted on vertical supports 105 by mounting brackets 107. The vertical supports are attached to the movable platform 22 by a separate set of mounting brackets 109. When the drive shaft 104 rotates, the pulling cable 108 winds around the pulling pulley 110 thereby pulling or sliding the patient across the transfer surface 103. In addition, the patient transfer assembly 100 also includes at least one rotating cable 112 that is fixed on one end to a pulling pulley 111 on the drive shaft 104, entrained over at least one hanging-guide pulley 114 and connected on the opposite end to any of the above-described gripper systems. If the gripper system is connected to the rotating cable 112, the patient may be lifted or rotated from the transfer surface 103 using the patient transfer assembly 100. As shown in FIG. 27, the rotating cable 112 is first entrained over a guide pulley 113 and then over at least one hanging-guide pulley 114 which is attached to a trapeze 115 extending above the transfer surface by a mounting bracket 116. As shown in this embodiment, the rotating cable 112 may be split thereby creating a cable having two ends for attaching two gripping components. When the drive shaft 104 rotates, the rotating cable 112 winds around the pulling pulley 111 on the drive shaft 104, pulling the rotating cable 112 over the guide pulley 113 and over the hanging-guide pulley 114 and, consequently, lifting or rotating the patient above the transfer surface 103. Additionally, drive pulley 106 has a smaller diameter than the diameter of pulleys 111, 113, 114. Any number of pulleys or cables could be used in alternate embodiments of this invention.

Figure 28:
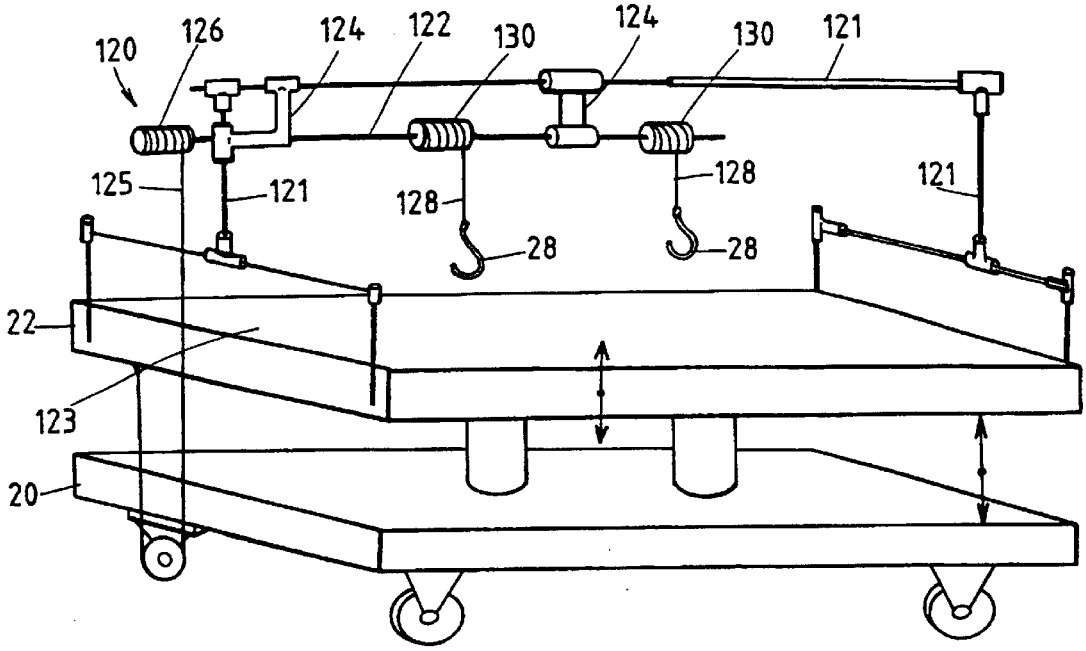
FIG. 28 is a perspective view of patient transfer assembly utilizing the power of an automatically moveable bed to rotate a patient and having a driving cable mounted on a trapeze above the moveable platform.

FIG. 28 shows another embodiment of the patient transfer assembly where the drive shaft is located above the patient to facilitate rotation or lifting of the patient. Patient transfer assembly 120 has a drive shaft 122 mounted on a trapeze 121 and located above the transfer surface 123. The drive shaft is attached to the trapeze 121 by a mounting brackets 124. The drive shaft 122 and the drive cable 125 are used in combination to transform the power of the automatically movable bed into a force which can be used to rotate or lift an incapacitated patient. The drive cable 125 is attached to a drive pulley 126 fixed to the drive shaft 122 and the movable platform 22 of the automatically movable bed. When the bed is raised, the drive cable 125 winds around a drive pulley 126. The drive shaft 122 rotates as a result of the drive cable 125 winding around the drive pulley 126. Two rotating cables 128 are attached to any of the aforementioned gripper systems, the C-shaped gripper component 28 is shown, and to guide pulleys 130. Because the guide pulleys 130 are fixed to the drive shaft 122, the guide pulleys 130 rotate when the drive shaft 122 rotates, thereby drawing the rotating cables 128 upward and away from the transfer surface 123. When any of the aforementioned gripper systems are attached to the sheet (not shown), the movement of the rotating cables 128 upward causes the gripper components to pull the sheet upward. As discussed previously, a patient transfer assembly having a multiple stroke movement construction, as shown in FIG. 28, will lift or rotate a patient a greater distance than those assemblies using a single stroke construction. The diameter of drive pulley 126 may be the same size as the diameter of pulleys 130 if using a multiple stroke construction. However, if using a single stroke construction, it is preferable to design drive pulley 126 with a smaller diameter than pulleys 130.

Referring generally to FIGS. 29–39, the patient transfer assembly, including at least one guide pulley, at least one cable and at least one gripper, may also be operated manually as compared to the aforementioned patient transfer assemblies which generate power from the movement of an automatically movable bed. For example, the power or pulling force to drive the patient transfer assembly may, in some embodiments, comes from the manual rotation of a drive shaft which pulls the grippers and, consequently, moves the patient. These embodiments of the patient transfer assembly are an improvement over other patient transfer mechanisms because these embodiments include structural elements that make using the assembly more comfortable and convenient. Some of the manually operated embodiments include an idler shaft that guides the cable over the transfer surface. When a patient transfer assembly includes an idler shaft, the drive shaft and handle, which is used to operate the drive shaft, may be adjustably positioned along a set of vertical supports that connect the assembly to the transfer surface so that the handle is at a comfortable and convenient level for the user. Other embodiments of the manually operated patient transfer assembly include an extension arm. The extension arm may be rotatably adjusted for to a comfortable level for the convenience of the user.

Figure 29:
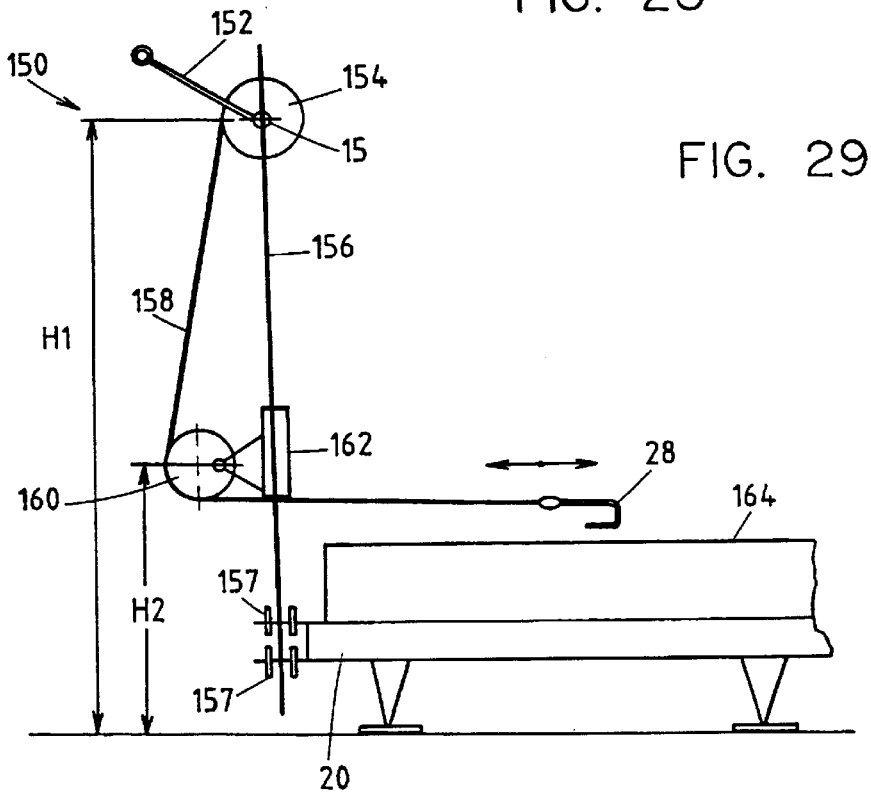
FIG. 29 is a side view of a manually operated patient transfer assembly having an idler shaft

Referring in particular to FIG. 29, the patient transfer system includes a driving system including a combination of driving and idler shafts or pulleys, a gripping system to grip the sheet on the bed and a cable to connect the gripper system to the driving system. The patient transfer assembly 150, as shown, includes a handle 152 for manual operation of the patient transfer assembly 150. The handle 152, for rotation of the drive shaft 154, is connected to the drive shaft 154 by a gear box (not shown). This mechanism provides the pulling force necessary to operate the patient transfer assembly 150.

With continued reference to FIG. 29, the drive shaft 154 is a bar-like component adapted on each end to be attached to vertical support bars 156, coupled to the structure (shown in this figure as the stationary base 20 of the bed) by mounting brackets 157. The drive shaft 154 is attached to each vertical support bar 156 by a mounting bracket 159. Although described and depicted as a bar in accordance with this embodiment of the invention, the drive shaft 154 may take any shape commonly known by those skilled in the art. The height (H1) of the drive shaft 154 above the transfer surface may vary because the drive shaft 154 may be adjusted along the vertical support bar 156. In alternative embodiments of the invention, the drive shaft 154 may be positioned below the transfer surface. When the handle 152 is rotated the drive shaft 154 rotates thereby winding a cable 158 around the drive shaft 154. The patient transfer assembly 150 also includes an idler shaft 160 which is attached to the vertical support bars 156 at a height (H2) which is adjacent the transfer surface 164. In this embodiment, the idler shaft 160 guides the cable 158 between the drive shaft 154 and the transfer surface 164. As the cable 158 is pulled, the grippers pull the sheet and the patient in the direction of the patient transfer assembly 150. The idler shaft 160 ensures that the cable 158 is properly aligned regardless of the position of the drive shaft 154 during operation of the patient transfer assembly 150. As shown in FIG. 29, the idler shaft 160 is fixedly attached to each vertical support bar 156 by a mounting bracket 162. In an alternative embodiments of the patient transfer assembly 150, the vertical supports 156 may be removably attached to the stationary base 20 by mounting brackets 162. In these embodiments, the patient transfer assembly 150 is portable because it can be easily be attached, detached and reattached to numerous structures.

It is advantageous to have the drive shaft 154 adapted to be adjusted to various heights because it is more comfortable and/or convenient for the user of the patient transfer assembly. Mechanisms for patient transfer, not in accordance with this invention, often position the drive shaft and handle at the height of the transfer surface, which is usually the top of a mattress, approximately 20–25 inches from the floor. When the drive shaft is positioned at this height, it may be difficult for a health care worker to operate the patient transfer assembly because they have to bend to the level of the handle which may be only 14 inches from the floor at the lowest position of the handle during each revolution. To alleviate such difficulties during operation, the some embodiments of the patient transfer assembly, in accordance with this invention, have height adjustable drive shafts and handles. Thus, a health care worker can move the handle to a height that is ergonomically comfortable and reduce strain on their back and neck muscles.

Figure 31:
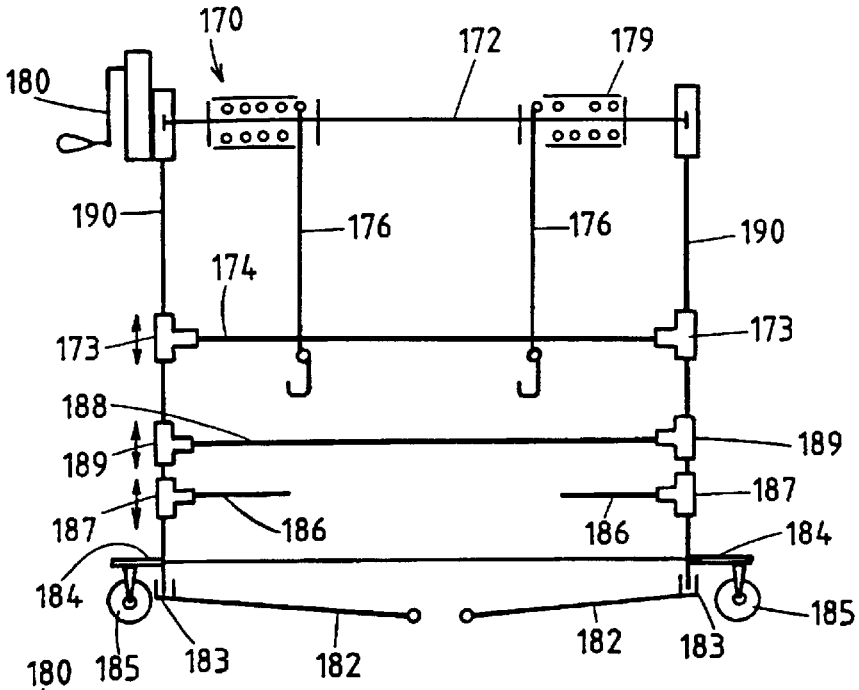
FIG. 31 is a front view of the patient transfer assembly of FIG. 30.
Figure 30:
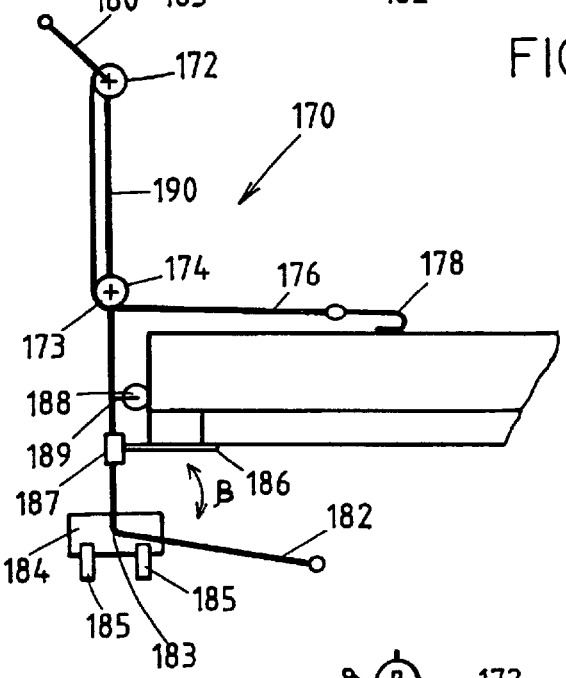
FIG. 30 is a side view of another embodiment of the manually operated patient transfer assembly having an idler shaft and support legs.
Figure 33:
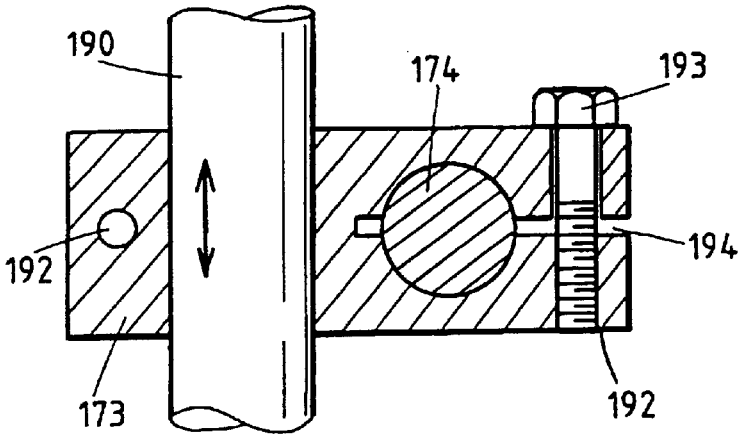
FIG. 33 is a cross-section view of the mounting bracket of FIG. 32.
Figure 32:
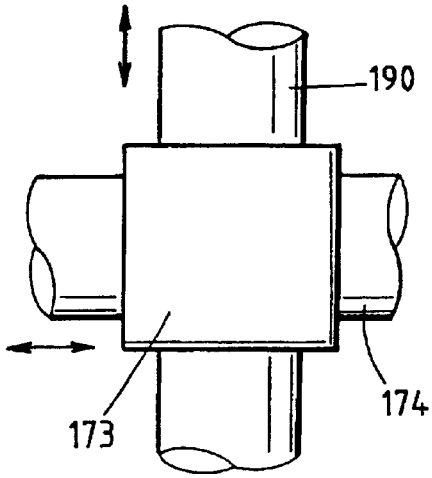
FIG. 32 is a side view of the adjustable mounting bracket.

The patient transfer assembly 170 shown in FIGS. 30–32 includes a drive shaft 172, an idler shaft 174, a cable 176, a C-shaped gripper component 28 (although any aforementioned gripper component could be used), a pulling pulley 179 and a handle 180, as shown in FIG. 29, but also includes an additional support leg 182, a wheeled base 184, a caster 185, a support arm 186 and a support rod 188. The patient transfer assembly 170 may be removably attached to the frame of the structure on which it is attached by mounting brackets (not shown). When the patient transfer assembly is removably connected to the structure, it is portable or movable and can be easily transported by rolling it on its casters to any transfer surface. As shown in FIG. 30, the support arm 186 slides beneath the platform of the bed which holds the mattress. The support rod 188 is mounted against the mattress of the bed to brace the bed against the patient transfer assembly 170 during operation of the assembly 170. As shown more clearly in FIG. 31, the drive shaft 172, the idler shaft 174, the support rod 188 and the support arm 186 may be adjusted to various heights along the vertical support bar 190. The idler shaft 174 is slidably connected to the vertical support bar 190 by mounting brackets 173. The support arm 186 is slidably connected to the vertical support bar 190 by mounting brackets 187. The support rod 188 is slidably connected to the vertical support bar 190 by mounting brackets 189. Because these structural components are height adjustable, the patient transfer assembly 170 may be used with a number of different structures, including but not limited to, a hospital bed, a wheel chair, a commode and a gurney. Additionally, because the patient transfer assembly is designed for mobility, this patient transfer assembly is light weight and may be easily stored. The mounting brackets 173 (FIGS. 32 & 33) may, in a preferred embodiment, include holes 191 into which the idler shaft 174 and vertical support bar 190 may be inserted. The mounting bracket 173 also includes holes 192 for inserting screws 193 to secure the mounting bracket 173 on the idler shaft 174 and vertical support bar 190. The mounting bracket 173 further includes a slot 194 which extends through the screw hole 192 and the hole 191 and may be clamped together as the screw is inserted into the bracket 173. When the slot 194 is clamped, the mounting bracket 173 may be securely mounted on the assembly 170. When the mounting bracket is not securely mounted on the assembly, the idler shaft 174 may be adjustably positioned along the vertical support bar 190. This mounting bracket 173, shown in FIGS. 32 & 33, is preferably the same as mounting brackets 187, 189 and may also be representative of any other mounting brackets discussed in association with the various embodiments of the patient transfer assembly.

Figure 34:
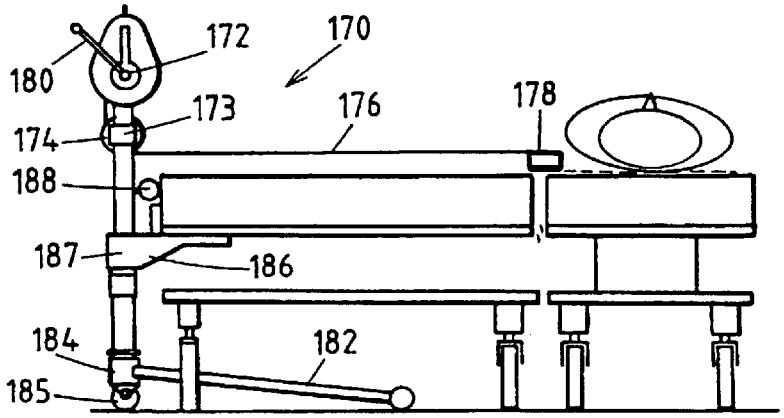
FIG. 34 is a side view of the patient transfer assembly of FIG. 30 gripping a sheet for transfer of the patient from a gurney to a bed.

Referring again to FIGS. 30 & 31, the support leg 182 is connected to the wheeled support base 184 by a mounting hinge 183 that allows the support leg 182 to be folded or flipped toward the adjacent vertical support bar 190. The support leg 182 moves through an arc indicated by direction arrow "β" of FIG. 30. While FIG. 34 depicts the assembly 170 as a structure for transporting a patient from a gurney to a bed, the assembly 170 may also be used with several different structures.

In some embodiments of the patient transfer assembly, the drive shaft may be rotated by a handle connected to a gear box or directly by a handle. Other embodiments of the patient transfer assembly may include an extension arm to assist with the manual rotation of a drive shaft. Additionally, the extension arm allows the handle and associated drive shaft to be positioned anywhere. For example, it may be extremely uncomfortable and difficult for a health care worker to use existing patient transfer assemblies because the worker has to bend over to reach handles positioned at the top of a transfer surface, such as a bed, which is generally 16–26 inches from the floor. However, by using an extension arm, as described below, a worker can raise the handle to a comfortable height and thereby reduce back and neck strain.

Figure 35:
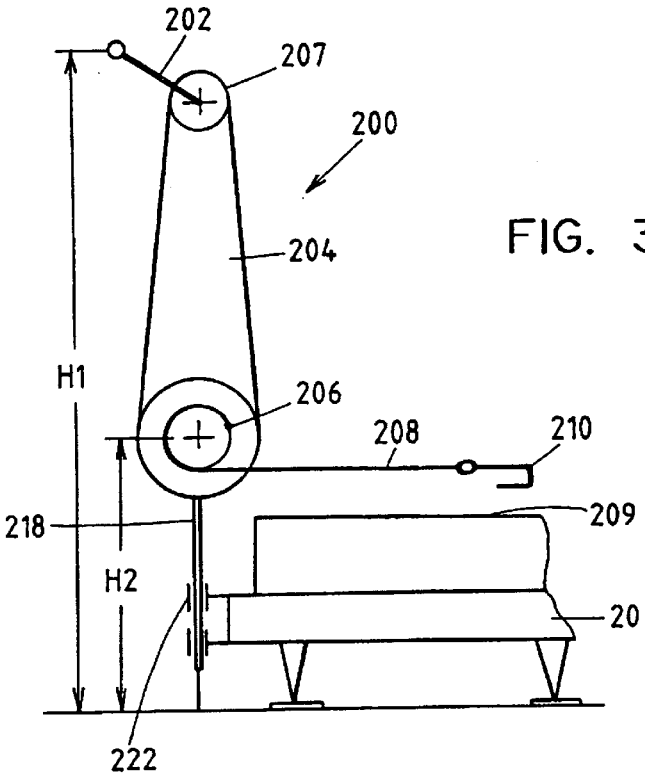
FIG. 35 is a side view of a manually operated patient transfer assembly having an extension arm.

Referring now to FIGS. 35–39, the patient transfer assembly 200 generates power to move a patient from the manual operation of a handle 202 connected to the patient transfer assembly 200 by an extension arm 204. As shown in FIG. 35, the extension arm 204 couples the drive shaft 206 to the handle 202. The handle may be coupled to the drive shaft by sprockets, gears, pulleys or any other transmissions (not shown) which may be located in a handle housing 207. The extension arm 204 makes it more convenient and comfortable for a health care worker to operate the patient transfer assembly 200 because the worker does not have to bend over thereby stressing his or her neck and back muscles. Just as the idler shaft of FIG. 29 allows the handle and drive shaft to be located at a height (H1) above the transfer surface, the extension arm 204, in this embodiment, allows the handle 202 to be located at the height (H1) which is ergonomically comfortable for rotation of the handle. In the embodiment of the patient transfer assembly depicted in FIG. 35, height (H1) is the height of the handle 202 when the handle 202 is at its highest position above the floor. In alternate embodiments of the patient transfer assembly 200, the handle 202 may be positioned at any height. When using an extension arm 204, the drive shaft 206 may be positioned at the height (H2) of the transfer surface without causing any inconvenience to the user of the patient transfer assembly 200. This patient transfer assembly 200, like the aforementioned assemblies, may be used to pull or slide a patient across a transfer surface 209 using a cable 208 and a gripper system. The gripper system may include any of the previously discussed gripper components, such as the C-shaped gripper component 210 shown in FIG. 35. The assembly 200 is supported by vertical supports 218 and coupled to the structure, shown in this embodiment as the stationary base 20, by mounting brackets 222. The vertical supports 218 may be permanently or removably connected to the bed. If the patient transfer assembly 200 is removably connected it can easily be disconnected, transported and reconnected to another bed or any other structure onto which or from which a patient must be moved.

Figure 36:
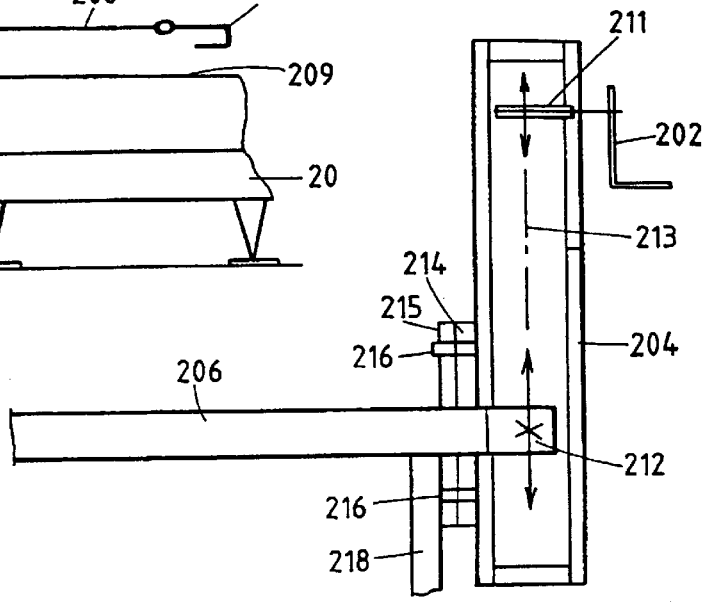
FIG. 36 is a cross-section view of the extension arm.

The extension arm may, in some embodiments, be an elongated gear box when the handle is connected to the input shaft of the gear box and the drive shaft is connected to the output shaft of the gear box. In an alternate embodiment, the output shaft of the gear box may be the drive shaft. As shown in FIG. 36, the extension arm may house a gear box which, in a preferred embodiment, may include an input sprocket 211 and an output sprocket 212 connected by a chain 213. The handle 202 for rotating the drive shaft 206 is coupled to the input sprocket 211, and the drive shaft 206 is coupled to the output sprocket 212. The extension arm 204 includes a flange 214 for mounting on a mounting bracket 215 which is attached to the vertical supports 218. In a preferred embodiment, the flange 214 is connected to the mounting bracket 215 by a screw or bolt 216. In alternate embodiments of the patient transfer assembly, the handle could be coupled to the drive by any other means knows to those skilled in the art.

Figure 39:
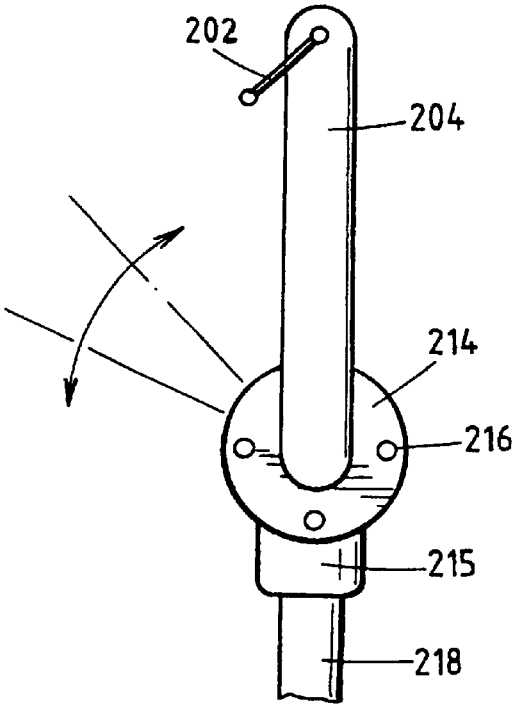
FIG. 39 is a side view of the extension arm rotably mounted on the vertical supports.
Figure 37:
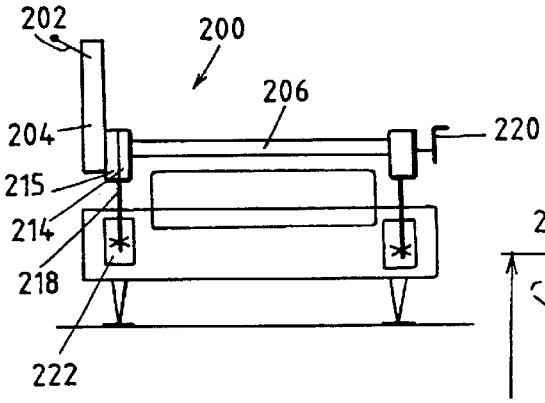
FIG. 37 is a front view of the patient transfer assembly of FIG. 35.
Figure 38:
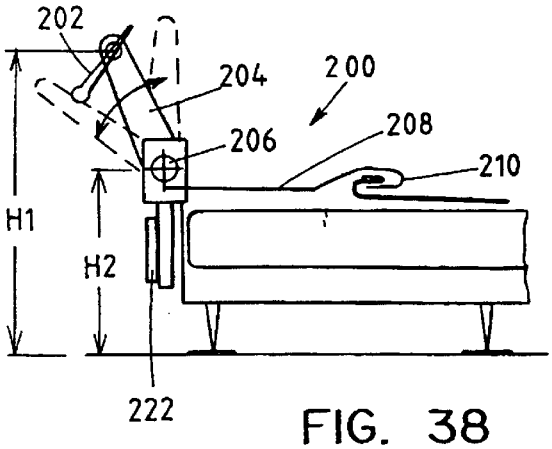
FIG. 38 is a side view of a patient transfer assembly having a rotatable extension arm.

As depicted in FIG. 37, a second handle 220 may be connected to the patient transfer assembly 200 at the level of the transfer surface. The second handle 220 may be added to the patient transfer assembly for the purposes of, but not limited to, moving light weight patients, such as children, or winding or unwinding the cables when not attached to the transfer sheet. As shown in FIG. 38, the extension arm 204 rotatably connected to the patient transfer assembly 200. Because the extension arm 204 may be rotated, the handle 202 may be positioned, for the convenience of the user. FIG. 39 shows the bolts 216 which may be removed so that the user can rotated the flange 214 to reposition the flange 214 on the mounting bracket 215.

Figure 40:
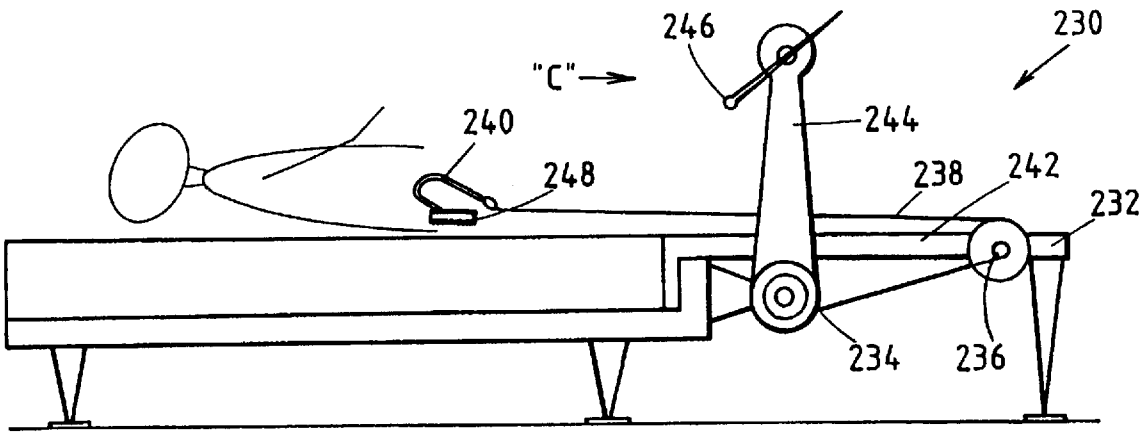
FIG. 40 is a side view of a patient transfer assembly having an extension arm attached to a commode.
Figure 41:
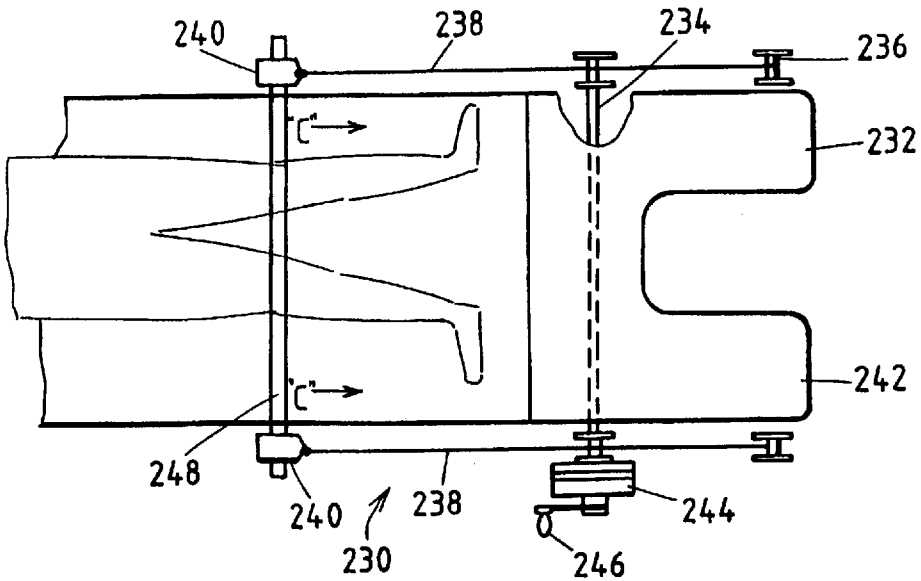
FIG. 41 is a top view of the patient transfer assembly of FIG. 40.

As discussed previously, the various embodiments of the patient transfer assembly are portable, which means that they can be attached, removed and reattached to a variety of structures. In particular, FIGS. 40 and 41 show an embodiment of the patient transfer assembly 230 which is connected to a commode 232. This embodiment of the patient transfer assembly 230 includes a drive shaft 234 and an idler shaft 236, as well as a cable 238 and a gripper system including a C-shaped gripper component 240 which is used to grasp and pull the sheet on which the patient rests. The cable 238 and C-shaped gripper component 240 have any of the characteristics previously discussed in connection with the aforementioned patient transfer assemblies. In this embodiment, the idler shaft 236 is positioned adjacent to the transfer surface 242 of the commode, and the drive shaft is positioned below the transfer surface 242 of the commode. The embodiment of the patient transfer assembly 230 of FIGS. 40 and 41 further includes an extension arm 244 and associated handle 246. The extension arm 244 extends above the transfer surface 242 so that a user does not have to bend down to the level of the drive shaft 234 and thereby make the assembly more comfortable to rotate. The patient transfer assembly 230, like the aforementioned assemblies, moves patients when a user rotates the handle 246 which in turn rotates the drive shaft 234 to pull the cable 238 entrained around the idler shaft 236, and any pulleys thereon, and, consequently, pull the gripper 240 attached to the end of the cable 238. FIG. 41 shows the C-shaped gripper component 240 and the cross-bar 248, as described previously, which are used to grasp the sheet on the transfer surface and pull the patient toward the commode in the direction indicated by direction arrows "c." The patient transfer assembly 230 may be permanently attached to the commode or temporarily attached. In alternate embodiments, the drive shaft 234 could be located above the transfer surface 242.

Figure 42:
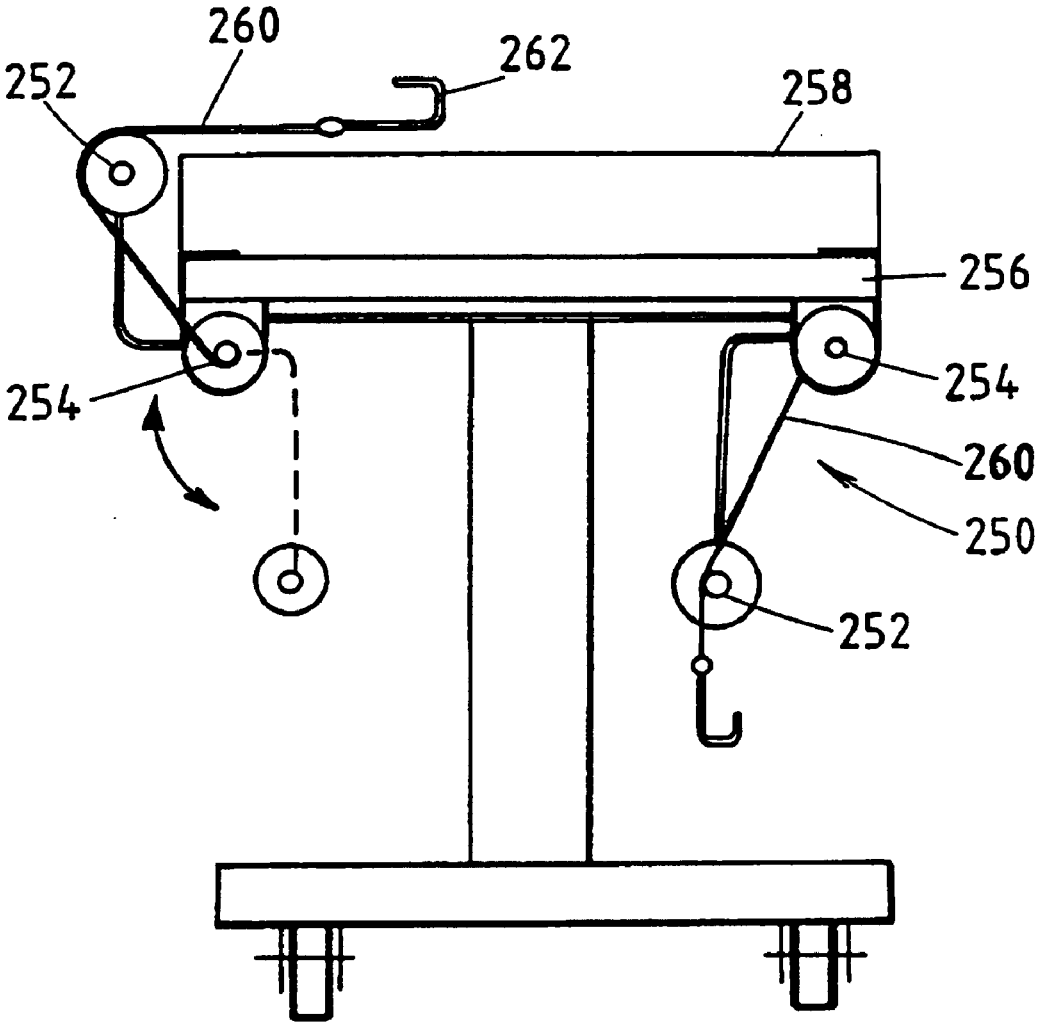
FIG. 42 is a side view of a patient transfer assembly attached to a gurney and having pivoting idler shaft.

As shown in FIG. 42, the patient transfer assembly 250 may include an idler shaft 252 which may be pivoted between positions. The drive shaft 254 is fixed to the under side of the gurney platform 256. The idler shaft 252 may be locked in a position adjacent to the transfer surface 258 to guide the cable 260 and C-shaped gripper component 262 of the gripper system as they are pulled across the surface during operation of the assembly 250. The idler shaft 252 may also be rotated from the first position adjacent the transfer surface to a second position where the idler shaft 252 hangs below the transfer surface 258. When the assembly 250 is not in use, the idler shaft 252 is positioned below the transfer surface 258 so that the assembly 250 does not become an obstacle for the patient during movement of the patient. Additionally, the adjustability of the idler shaft 252 in this embodiment makes it easier to store the patient transfer assembly 250 when not in use. Although the patient transfer assembly 250 is shown on a gurney in FIG. 36, the patient transfer assembly 250 could also be used on a number of different structures including, but not limited to, a bed, a commode or a wheel chair.

Figure 43:
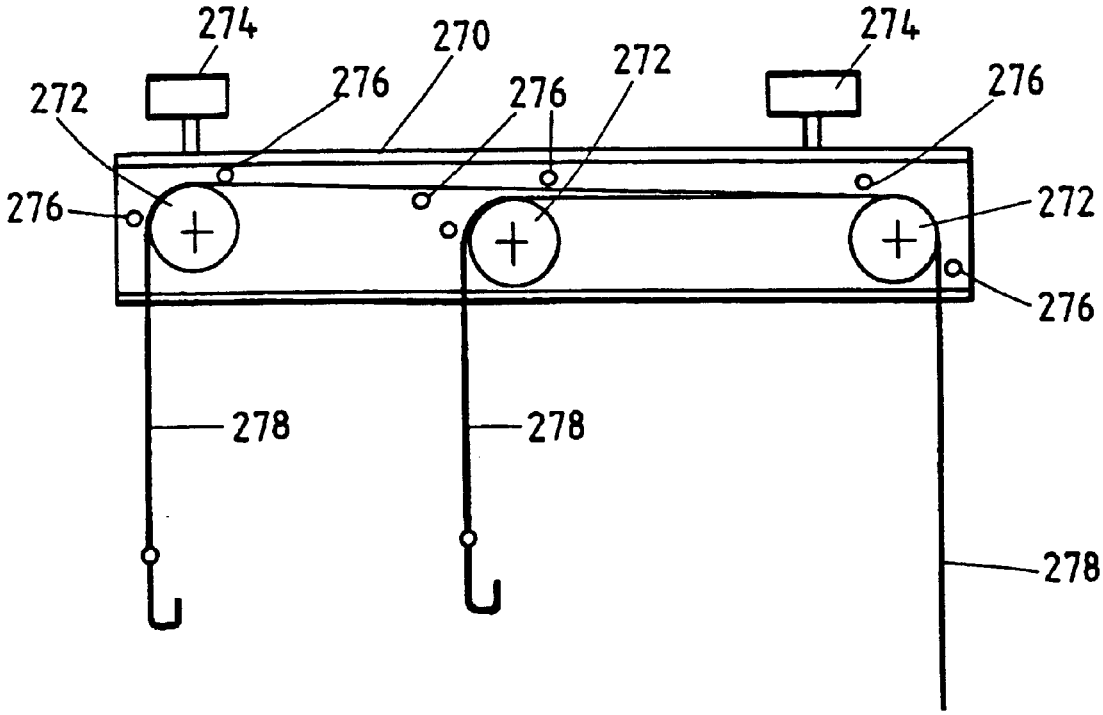
FIG. 43 is a side view of the trapeze and associated housing for the guide pulleys of the patent transfer assembly.
Figure 44:
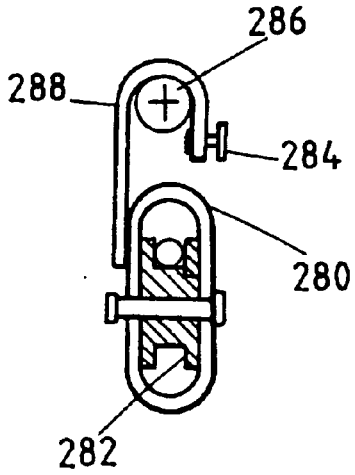
FIG. 44 is a cross-section view of guide pulley.

FIG. 43 shows a housing 270 for several hanging guide pulleys 272 utilized in a patient transfer assembly for rotating or lifting a patient. The housing 270 may be attached to the patient transfer assembly by mounting brackets 274. Pins 276 keep the cable 278 properly aligned on each respective pulley 274. Although not depicted, all of the aforementioned embodiments of the patient transfer assembly may be equipped with pins to guide the cables. FIG. 44 shows the housing 280 used in association with a hanging guide pulley 282 to protect the guide pulley 282. The housing 280 is attached to the trapeze 286 by means of a mounting bracket 288. A locking nut 284 clamps the mounting bracket 288 to the trapeze 286 the maintain a secure connection during operation of the assembly. All aforementioned embodiments of the patient transfer assembly may be equipped with a mounting bracket and a locking nut to securely connect the pulleys and other elements of the assembly to the structural frame of the assembly.

In some embodiments of the aforementioned patient transfer assemblies the cable can be attached to the assembly or, alternatively, to the transfer structure by a quick disconnect. This quick disconnect allows the cable to be quickly and easily removed from the system which may be useful for storage purposes.

The invention has been described in terms of several preferred embodiments. The description of these embodiments should in no way be considered limiting of the broad scope of the invention set forth in the following claims.

What is claimed is:

1. A patient positioning assembly for moving a sheet on which a patient is disposed, the sheet being supported by a structure having a transfer surface, the patient positioning assembly comprising:

a support frame;

a drive shaft coupled to the frame;

a guiding element coupled to the support frame and adjustably positionable adjacent the transfer surface;

a cable connected to the drive shaft, an intermediate portion of the cable passing at least partially around the guiding element, so that operation of the drive shaft pulls the cable;

a gripper system adapted for attachment to the sheet and operatively coupled to the cable; and a handle connected to the drive shaft through a gear box, the handle being height adjustable for ergonomically comfortable rotation of the drive shaft.

2. The patient positioning assembly of claim 1, wherein the guiding element comprises an idler shaft adjustably coupled to the support frame.

3. The patient positioning assembly of claim 2, wherein the drive shaft is positioned below the transfer surface, and the idler shaft is adapted to be moved between a first position and a second position.

4. The patient positioning assembly of claim 3, wherein the first position is below the transfer surface and the second position is above the transfer surface.

5. The patient positioning assembly of claim 1, in which the gripper system comprises a cross-member adapted to engage the sheet and a first gripper unit sized to engage the cross-member.

6. The patient positioning assembly of claim 5 in which the gripper system further comprises a second gripper unit sized to engage the cross-member.

7. The patient positioning assembly of claim 1, in which the drive shaft is positioned above the support surface.

8. The patient positioning assembly of claim 1, in which the drive shaft is positioned below the support surface.

9. The patient positioning assembly of claim 1, in which the drive shaft is positionable on the frame at different vertical heights, thereby to adjust the height of the handle.

10. The patient positioning assembly of claim 1, in which the gear box is elongated to define an extension arm, and in which the extension arm is pivotable to adjust the height of the handle.

11. The patient positioning assembly of claim 10, further comprising locking members for securing the extension arm in a pivoted position.

12. The patient positioning assembly of claim 1, in which the gear box is elongated to define an extension arm, the extension arm including an input shaft coupled to the handle, an output shaft coupled to the drive shaft.

13. The patient positioning assembly of claim 1, in which the support frame includes at least two vertical bars.

14. The assembly of claim 1, further comprising a wheeled base attached to a bottom of the support frame.

15. The assembly of claim 14, further comprising a support leg pivotably attached to the wheeled base and movable between a first position in which the support leg is adjacent the frame and a second position in which the support leg is rotated away from the frame to stabilize the frame.

16. The assembly of claim 1, further comprising a support arm attached to the support frame and positionable to engage a bottom of the structure.

17. The assembly of claim 1, further comprising a support rod attached to the support frame and extending toward the structure for maintaining a space between the structure and the support frame.

18. A patient positioning assembly for moving a sheet on which a patient is positioned, the sheet being supported by a structure having a transfer surface, the assembly comprising:

an assembly support;

a guiding element coupled to the assembly support and adjustably positioned adjacent the transfer surface;

a cable having a fixed, a free end, and an intermediate portion passing at least partially around the guiding element;

a drive coupled to the fixed end of the cable and adapted to pull the cable;

a gripper system adapted for attachment to the sheet and operatively coupled to the cable, the gripper system including a gripper unit having a connection end releasably coupled to the free end of the cable such that the cable engages the gripper unit when pulled in a first direction but is released when pulled in a second direction, thereby to automatically disengage the cable from the gripper unit.

19. The assembly of claim 18, in which the connection end of the gripper defines a pinch surface, a first cable receiving opening positioned relatively closer to the pinch surface, and a second cable receiving opening positioned relatively farther from the pinch surface, wherein the cable free end is inserted through the second cable receiving opening and back through the first cable receiving opening so that an intermediate portion of the cable applies a pinch load that pushes the cable second end against the pinch surface as the cable is pulled in a direction generally parallel to the pinch surface.

20. The assembly of claim 18, in which the second direction is substantially perpendicular to the first direction.

21. The assembly of claim 18, in which a direction of cable pull changes from the first direction to the second direction as the gripper unit rotates about the guiding element.

* * * * *

UNITED STATES PATENT AND TRADEMARK OFFICE

CERTIFICATE OF CORRECTION

PATENT NO. : 6,629,323 B2
DATED : October 7, 2003
INVENTOR(S) : David Sverdlik et al.

It is certified that error appears in the above-identified patent and that said Letters Patent is hereby corrected as shown below:

Column 20,
Line 5, please delete "fixed," and insert -- fixed end, --.

Signed and Sealed this

Tenth Day of February, 2004

JON W. DUDAS
*Acting Director of the United States Patent and Trademark Office*